US007198759B2

(12) United States Patent
Bryning et al.

(10) Patent No.: US 7,198,759 B2
(45) Date of Patent: Apr. 3, 2007

(54) MICROFLUIDIC DEVICES, METHODS, AND SYSTEMS

(75) Inventors: Zbigniew T. Bryning, Campbell, CA (US); John Shigeura, Portola Valley, CA (US)

(73) Assignee: Applera Corporation, Foster City, CA (US)

( * ) Notice: Subject to any disclaimer, the term of this patent is extended or adjusted under 35 U.S.C. 154(b) by 527 days.

(21) Appl. No.: 10/336,274

(22) Filed: Jan. 3, 2003

(65) Prior Publication Data

US 2007/0041878 A1 Feb. 22, 2007

Related U.S. Application Data

(60) Provisional application No. 60/398,851, filed on Jul. 26, 2002, provisional application No. 60/398,946, filed on Jul. 26, 2002.

(51) Int. Cl.
*B01L 3/02* (2006.01)

(52) U.S. Cl. ..... 422/100; 422/99; 422/102; 422/103

(58) Field of Classification Search ..... 422/99–103
See application file for complete search history.

(56) References Cited

U.S. PATENT DOCUMENTS

| | | | | |
|---|---|---|---|---|
| 4,511,534 A | * | 4/1985 | Bennett et al. | 422/100 |
| 5,110,552 A | * | 5/1992 | Guigan | 422/64 |
| 5,154,888 A | * | 10/1992 | Zander et al. | 422/58 |
| 5,254,479 A | | 10/1993 | Chemelli | |
| 5,288,463 A | | 2/1994 | Chemelli | |
| 5,290,518 A | | 3/1994 | Johnson | |
| 5,800,785 A | * | 9/1998 | Bochner | 422/101 |
| 5,879,635 A | * | 3/1999 | Nason | 422/102 |
| 6,048,734 A | | 4/2000 | Burns et al. | 436/180 |
| 6,068,751 A | | 5/2000 | Neukermans | 204/601 |
| 6,102,897 A | | 8/2000 | Lang | 604/246 |
| 6,302,134 B1 | | 10/2001 | Kellogg et al. | 137/74 |
| 6,375,901 B1 | | 4/2002 | Robotti et al. | 422/103 |
| 6,379,929 B1 | | 4/2002 | Burns et al. | 435/91.2 |
| 6,390,791 B1 | | 5/2002 | Maillefer et al. | 417/413.3 |
| 6,399,396 B1 | * | 6/2002 | Bass | 436/180 |
| 6,408,878 B2 | | 6/2002 | Unger et al. | 137/597 |
| 6,426,230 B1 | | 7/2002 | Feistel | |
| 6,431,212 B1 | | 8/2002 | Hayenga et al. | 137/855 |

(Continued)

FOREIGN PATENT DOCUMENTS

| | | |
|---|---|---|
| WO | WO 97/21090 | 6/1997 |

(Continued)

OTHER PUBLICATIONS

International Search Report for International Application No. PCT/US03/22068, dated Sep. 26, 2003.

*Primary Examiner*—Brian R. Gordon
(74) *Attorney, Agent, or Firm*—Kilyk & Bowersox, P.L.L.C

(57) ABSTRACT

Microfluidic assemblies, systems, and methods are provided for manipulating fluid samples. Assemblies include an elastically deformable cover layer and a less elastically deformable substrate. The methods include deforming the substrate through the cover layer so that when the cover layer rebounds a new communication results in the assembly between the cover layer and the substrate and/or so that a new barrier wall is formed. Systems for carrying out the methods are also provided.

20 Claims, 16 Drawing Sheets

U.S. PATENT DOCUMENTS 6,494,433 B2 12/2002 Mastrangelo et al. ..... 251/11
6,508,988 B1 * 1/2003 Van Dam et al. ..... 422/102
6,518,060 B2 * 2/2003 Heimberg et al. ..... 435/305.3
6,565,752 B1 * 5/2003 Baron et al. ..... 210/635
6,627,159 B1 * 9/2003 Bedingham et al. ..... 422/100
6,645,758 B1 * 11/2003 Schnipelsky et al. .... 435/287.2
6,793,753 B2 * 9/2004 Unger et al. ..... 156/155
6,814,935 B2 * 11/2004 Harms et al. ..... 422/99
6,833,112 B2 * 12/2004 Hoummady ..... 422/61
6,929,239 B1 * 8/2005 Colin et al. ..... 251/115
2001/0029983 A1 10/2001 Unger et al. ..... 137/597
2001/0033796 A1 10/2001 Unger et al. ..... 417/53
2001/0054778 A1 12/2001 Unger et al. ..... 264/239
2002/0029814 A1 3/2002 Unger et al. ..... 137/824
2002/0043638 A1 4/2002 Kao et al. ..... 251/129.06
2002/0048533 A1 4/2002 Harms et al. ..... 422/99
2002/0054835 A1 5/2002 Robotti et al. ..... 422/103
2002/0064885 A1 * 5/2002 Bedingham et al. ..... 436/174
2002/0117517 A1 8/2002 Unger et al. ..... 222/214
2002/0144738 A1 10/2002 Unger et al. ..... 137/824
2002/0148992 A1 10/2002 Hayenga et al. ..... 251/61.1
2002/0168278 A1 11/2002 Jeon et al. ..... 417/559
2002/0195579 A1 12/2002 Johnson ..... 251/11
2003/0008411 A1 * 1/2003 Van Dam et al. ..... 436/174
2003/0143122 A1 * 7/2003 Sander ..... 422/100
2003/0143754 A1 * 7/2003 Lum et al. ..... 436/180
2003/0150792 A1 * 8/2003 Koehler et al. ..... 210/321.84
2003/0156995 A1 8/2003 Gilligan et al.
2003/0175162 A1 * 9/2003 Anazawa et al. ..... 422/99
2003/0190265 A1 * 10/2003 Anazawa et al. ..... 422/103
2003/0198576 A1 * 10/2003 Coyne et al. ..... 422/100
2004/0018116 A1 * 1/2004 Desmond et al. ..... 422/58
2004/0058452 A1 * 3/2004 Fisher et al. ..... 436/180
2004/0082076 A1 * 4/2004 Zengerle et al. ..... 436/180
2004/0141885 A1 * 7/2004 Godin et al. ..... 422/100
2004/0232074 A1 * 11/2004 Peters et al. ..... 210/634
2004/0265180 A1 * 12/2004 Cox et al. ..... 422/99
2005/0047962 A1 * 3/2005 Laurell et al. ..... 422/63
2005/0266582 A1 * 12/2005 Modlin et al. ..... 436/164

FOREIGN PATENT DOCUMENTS

WO WO 02/074438 A2 9/2002

* cited by examiner

Fig. 1b.
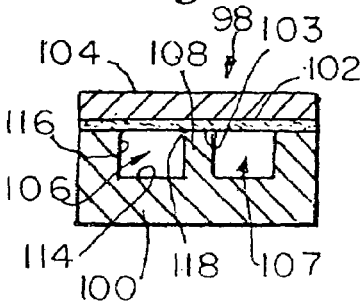
Fig. 2b.
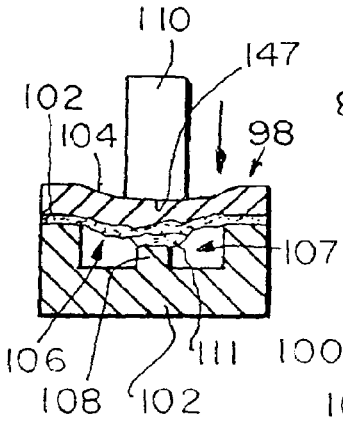
Fig. 3b.
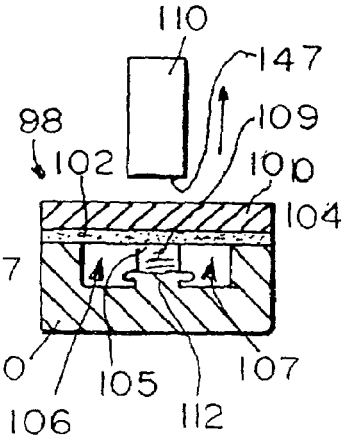
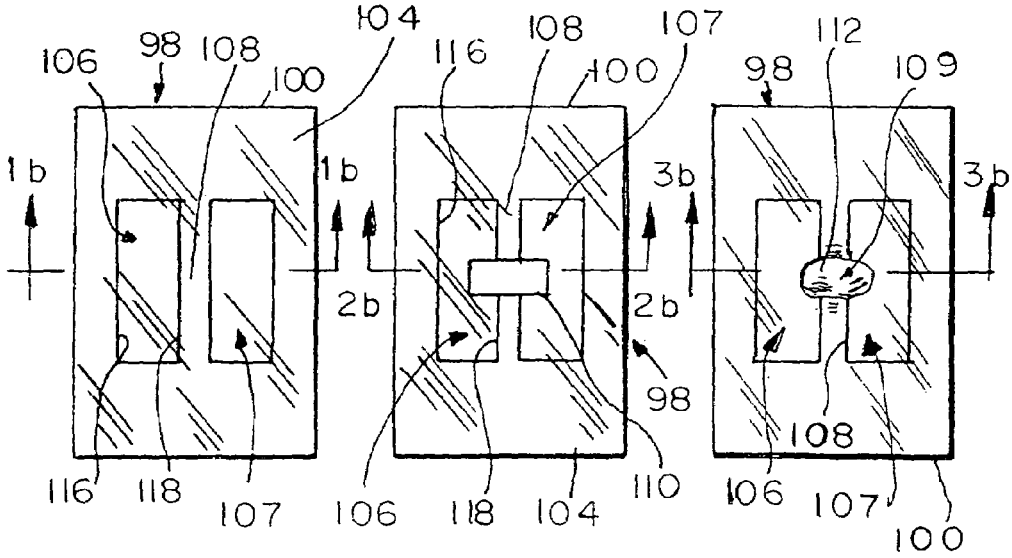
Fig. 1a. Fig. 2a. Fig. 3a.

Fig. 4b.
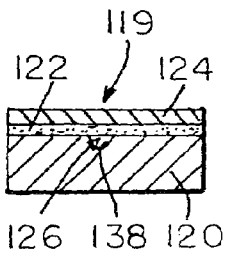
Fig. 5b.
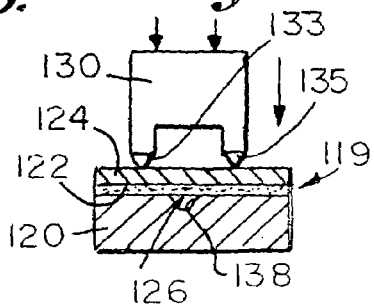
Fig. 6b.
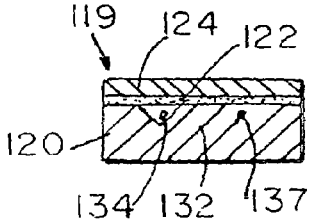
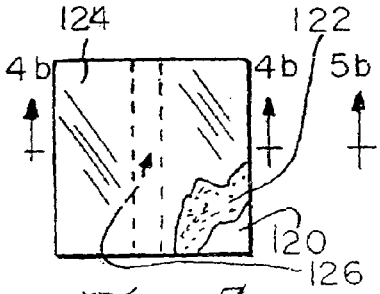
Fig. 4a.
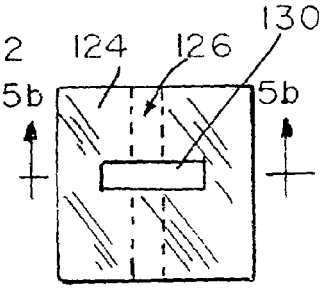
Fig. 5a.
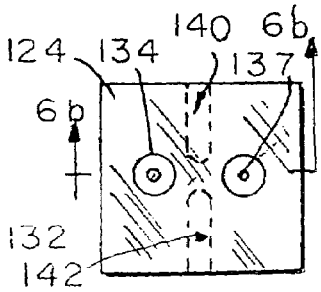
Fig. 6a.
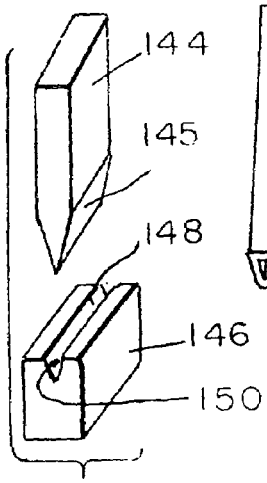
Fig. 7.
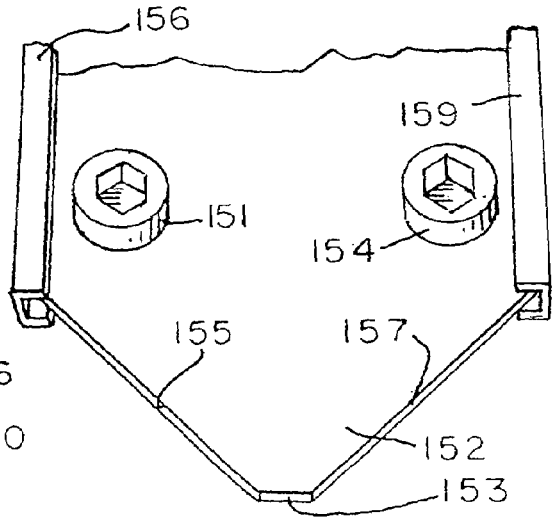
Fig. 8.

Fig. 9.
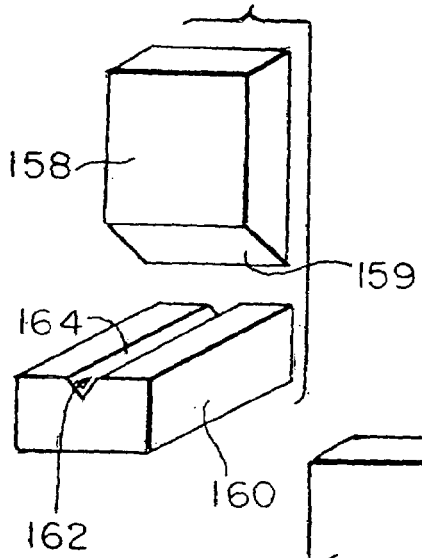
Fig. 10.
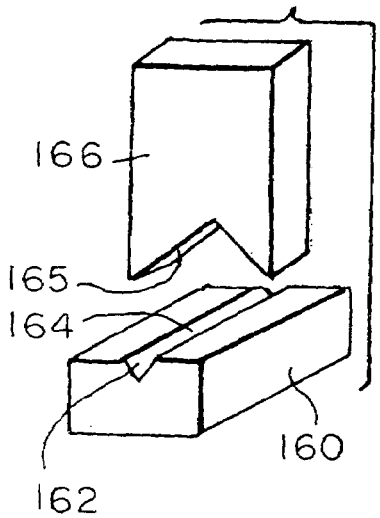
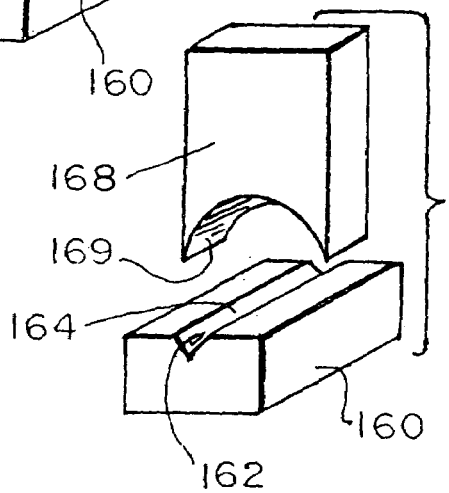
Fig. 11.
Fig. 12.
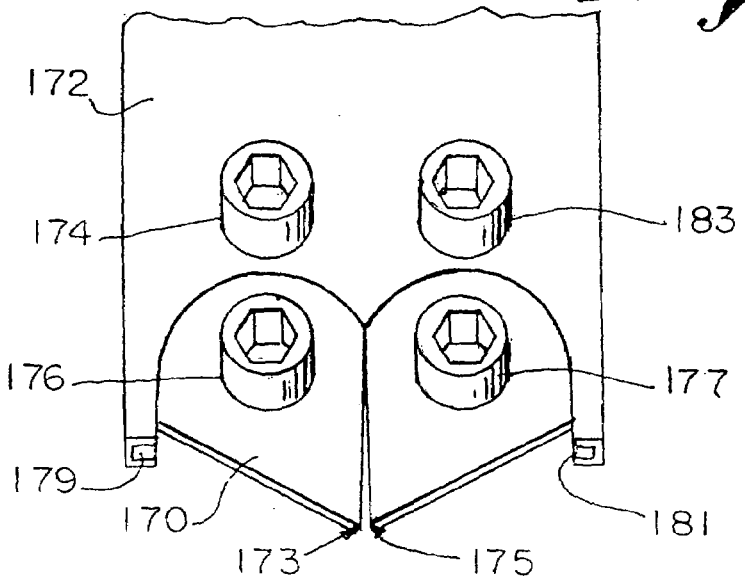

Fig.28.
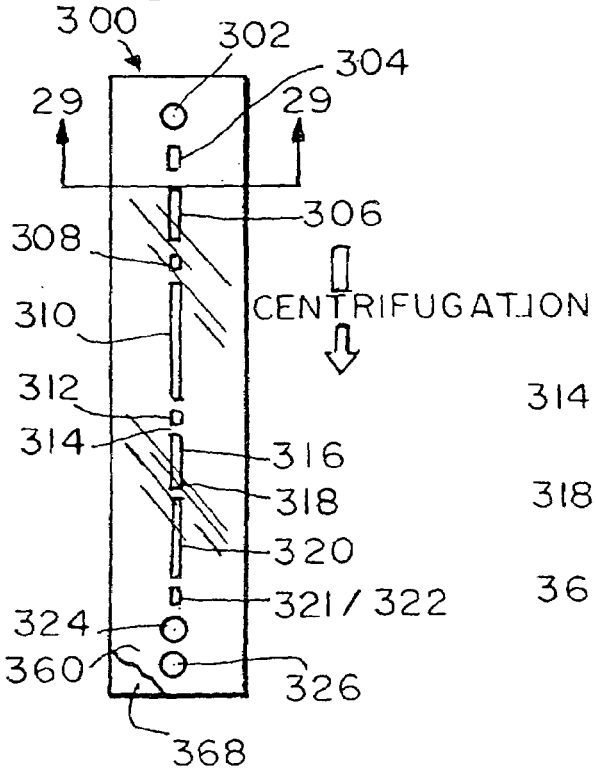
Fig.30.
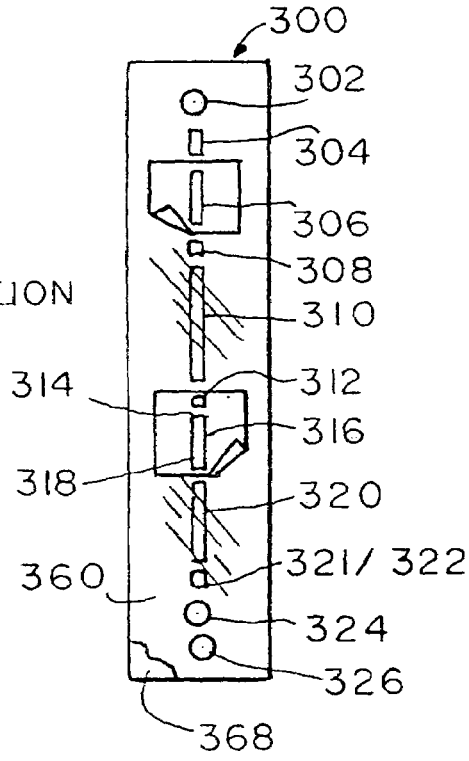
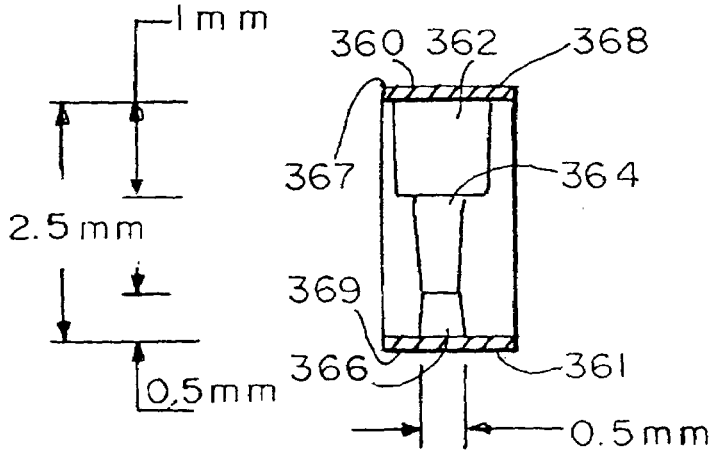
Fig.29.

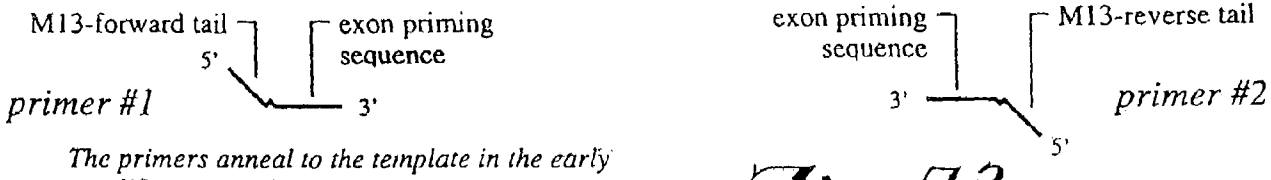
Fig. 42.
The primers anneal to the template in the early amplification cycles.
Fig. 43.
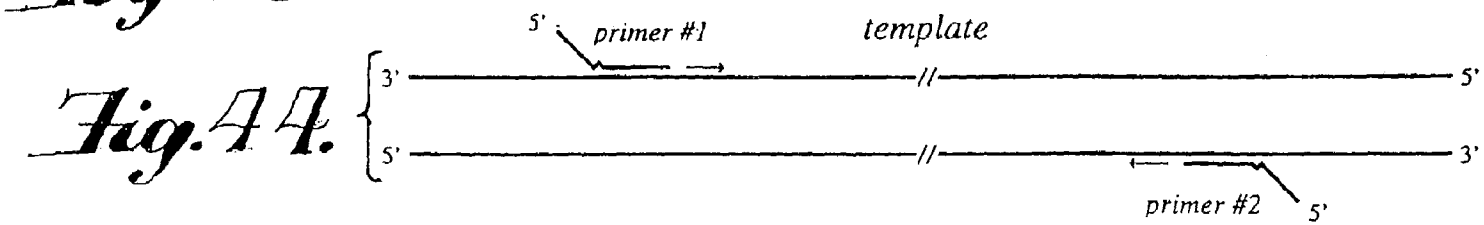
Fig. 44.
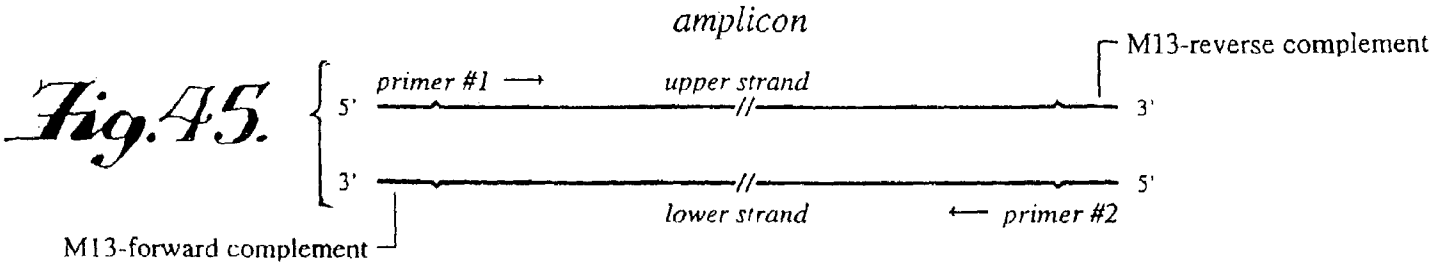
Fig. 45.

MICROFLUIDIC DEVICES, METHODS, AND SYSTEMS

CROSS REFERENCE TO RELATED APPLICATIONS

The present application claims the benefit of U.S. Provisional Patent Applications Nos.: 60/398,851 and 60/398,946, both filed Jul. 26, 2002, and both of which are incorporated herein in their entireties by reference. Cross-reference is also made to U.S. patent application Ser. Nos. 10/336,706 and 10/336,330, both filed Jan. 3, 2003, both of which are also herein incorporated in their entireties by reference.

FIELD

The present invention relates to microfluidic devices, and methods and systems using such devices. The present invention relates to devices that manipulate, process, or otherwise alter micro-sized amounts of fluids and fluid samples.

BACKGROUND

Microfluidic devices are useful for manipulating fluid samples. There continues to exist a demand for microfluidic devices, methods of using them, and systems for processing them, that are fast, reliable, consumable, and that can process many samples simultaneously.

SUMMARY

According to various embodiments, a fluid manipulation assembly is provided having two or more recesses separated by one or more intermediate walls. The intermediate wall can be a deformable material, for example, an elastically deformable material, that can be deformed to cause a fluid communication between two or more of the recesses. If the intermediate wall is elastically deformable, it can be made of a material that exhibits less elasticity, that is, is not as elastically deformable or is not as quickly elastically rebounding as the cover layer. According to various embodiments, an elastically deformable cover layer covers at least one of the recesses and contacts the immediate wall when the intermediate wall is in a non-deformed state. The elastically deformable cover layer can be designed not to contact the intermediate wall when the intermediate wall is in the deformed state.

According to various embodiments, a fluid manipulation assembly is provided that includes a recess with two or more recess portions where the recess is at least partially defined by an opposing wall surface portion that includes a deformable inelastic material. The recessed portions are in fluid communication with each other when the deformable inelastic material is in the non-deformed state. The opposing wall surface portion that includes the deformable inelastic material can be deformed to cause a barrier wall between the two recessed portions. The barrier wall can prevent fluid communication between the two recessed portions. An elastically deformable cover layer covers at least a portion of the recess and can cover at least an entire recess. The elastically deformable cover layer can contact the barrier wall when the barrier wall is formed. Various embodiments provide a system including such an assembly and various other components.

According to various embodiments, a deformer can be provided that contacts the elastically deformable cover layer of the assembly and deforms an intermediate wall. The deformer can then retract out of contact with the elastically deformable material layer whereby the layer rebounds to result in a fluid communication between the recesses separated by the intermediate wall. According to various embodiments, the deformer can deform a sidewall portion of a recess to form a barrier wall separating two portions of the recess.

Methods are also provided for deforming an intermediate wall to cause a fluid communication between two or more recesses in a covered substrate. The methods can include contacting an elastically deformable cover layer of an assembly and deforming an intermediate wall underneath the deformed cover layer.

According to various embodiments, methods are provided for forming a barrier wall to interrupt fluid communication between two recessed portions using an assembly and deformer described herein. Methods are provided whereby two or more recessed portions in an assembly as described herein having an opposing wall surface portion of a deformable inelastic material is deformed to form a barrier wall. An elastically deformable cover layer covers at least part of the recessed portion where the opposing wall surface made up of at least the deformable inelastic material is deformable to form a barrier wall. The barrier wall is preferably formed between at least two portions of the recess and interrupts fluid communication between the at least two portions of the recess when in a deformed state. The methods include contacting the elastically deformable cover layer with the deformer and inelastically deforming the deformable inelastic material to form a barrier wall, then allowing the cover layer to elastically rebound. The result can be a contact between the cover layer and the barrier wall after deformation.

According to various embodiments, a microfluidic manipulation system is provided having a fluid manipulating assembly, an assembly support platform, an assembly deformer, and a positioning unit, wherein the positioning unit is adapted to position the deformer relative to the fluid manipulating assembly. When the fluid manipulating assembly is on the assembly support platform, the deformer can be forced to deform the deformable inelastic material through the elastically deformable material layer, to form a fluid communication between the first and second recesses.

These and other embodiments can be more fully understood with reference to the accompanying drawing figures and the descriptions thereof. Modifications that would be recognized by those skilled in the art are considered a part of the present invention and within the scope of the appended claims.

BRIEF DESCRIPTION OF THE DRAWINGS

FIG. 1*a* is a top view of a microfluidic device according to an embodiment wherein two recesses in a substrate are separated by an intermediate wall formed from a deformable inelastic material;

FIG. 1*b* is a cross-sectional side view of the assembly shown in FIG. 1*a*, taken along line 1*b*—1*b* of FIG. 1*a;*

FIG. 2*a* is a top view of the assembly shown in FIG. 1*a* along with a deformer device positioned after initiation of an intermediate wall deforming step;

FIG. 2*b* is a cross-sectional side view of the assembly and deformer shown in FIG. 2*a*, taken along line 2*b*—2*b* of FIG. 2*a*, and showing the contact surface of the deformer advancing toward the intermediate wall;

FIG. 3*a* is a top view of the assembly shown in FIG. 1*a* but wherein the intermediate wall is in a deformed state following contact of the deformer with the intermediate wall;

FIG. 3*b* is as cross-sectional side view of the assembly shown in FIG. 3*a* taken along line 3*b*—3*b* of FIG. 3*a*, showing the contact surface of the deformer retracting from the intermediate wall in a deformed state;

FIG. 4*a* is a top view with partial cutaway of a microfluidic assembly according to an embodiment wherein a substrate is comprised of a recess that can be divided into two recessed portions;

FIG. 4*b* is a cross-sectional side view of the assembly shown in FIG. 4*a*, taken along line 4*b*—4*b* of FIG. 4*a;*

FIG. 5*a* is a top view of the assembly shown in FIG. 4*a* along with a deformer positioned at the initiation of an opposing wall surface portion deforming step;

FIG. 5*b* is cross-sectional side view of the assembly and deformer shown in FIG. 5*a*, taken along line 5*b*—5*b* of FIG. 5*a*, showing the contact surface of the deformer advancing toward the deformable opposing wall surface portions;

FIG. 6*a* is a top view of the assembly shown in FIG. 4*a* following contact of the deformer with the opposing wall surface portions;

FIG. 6*b* is a cross-sectional side view of the assembly shown in FIG. 6*a*, taken along line 6*b*—6*b* of FIG. 6*a;*

FIG. 7 is a perspective view of a deformer and substrate according to an embodiment wherein a fluid communication can be formed;

FIG. 8 is a perspective view of a deformer mounted on a system according to an embodiment wherein the deformer has a plurality of screws to fix the deformer to the microfluidic manipulation system;

FIGS. 9–11 are perspective views of deformers and substrates according to embodiments wherein a fluid communication channel having at least one opposing wall surface portion comprised of deformable inelastic material can be interrupted by a barrier wall formed from the deformer;

FIG. 12 is a perspective view of a deformer and system according to an embodiment wherein the deformer has a plurality of contact surfaces and a plurality of screws to fix the deformer to the microfluidic manipulation system;

FIG. 28 is a view of the assembly shown in FIG. 17 and the cross-sectional line 29—29 resulting in the partial cross-section shown in FIG. 29;

FIG. 29 is a cross-sectional view taken along line 29—29 of FIG. 28;

FIG. 30 is a top plan view of an assembly according to an embodiment that includes film covers over various channels and chambers of the assembly;

FIGS. 42 and 43 show exemplary PCR primers useful in methods according to various embodiments;

FIGS. 44 and 45 show the template and amplicon, respectively, that are used and result from a PCR step according to various method embodiments.

Figure 13A:
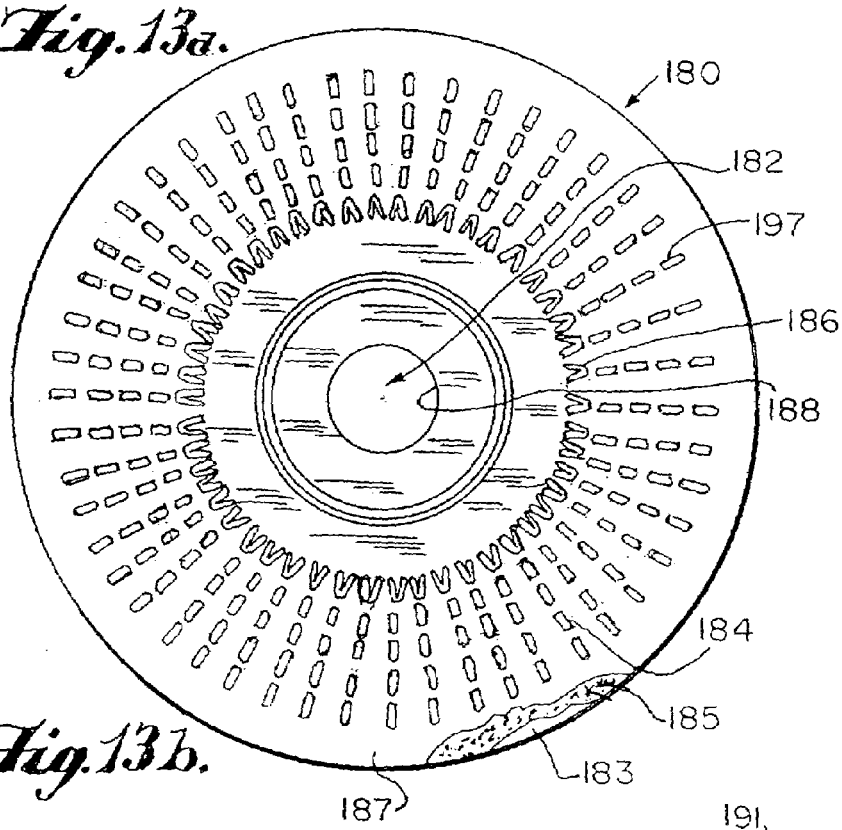
FIG. 13*a* is a top view of a disk-shaped fluid manipulating assembly according to an embodiment showing a plurality of radially extending series of recesses in the substrate.

Other various embodiments of the present invention will be apparent to those skilled in the art from consideration of the specification and practice of the invention described herein, and the detailed description that follows. It is intended that the specification and examples be considered as exemplary only, and that the true scope and spirit of the invention includes those other various embodiments.

DETAILED DESCRIPTION OF CERTAIN EMBODIMENTS

FIG. 1*a* is a top view of a microfluidic assembly 98 according to an embodiment wherein two recesses 106 and 107 are formed in a substrate layer 100 and are separated by an intermediate wall 108 formed from a deformable material. The material of the intermediate wall can be inelastically deformable or elastically deformable.

If the material of the intermediate wall is elastically deformable, it can be less elastically deformable (have less elasticity) than the material of the cover layer, or at least not as quickly elastically rebounding as the material of the cover layer, whereby the cover layer is able to recover or rebound from deformation, more quickly than the intermediate wall material. Thus, if both the cover layer and the intermediate wall are elastically deformable but to different degrees, the cover layer can rebound from deformation more quickly than the intermediate wall material and a gap can therefore be provided therebetween, that can function as an opening for a fluid communication. For the sake of example, but not to be limiting, the intermediate wall material will be described below as being inelastically deformable.

FIG. 1*b* is a cross-sectional side view of the assembly 98 shown in FIG. 1*a*, taken along line 1*b*—1*b* of FIG. 1*a*. The assembly 98 also includes an elastically deformable cover layer 104 and a pressure-sensitive adhesive layer 102 disposed between the substrate 100 and the elastically deformable cover layer 104. The recess 106 is at least partially defined by sidewalls 116 and 118 and bottom wall 114 as shown in FIG. 1*b*. In the non-deformed state, intermediate wall 118 has a top surface that is in contact with and sealed by the pressure sensitive adhesive 102 at interface 103.

FIG. 2*a* is a top view of the assembly 98 shown in FIG. 1*a* in deforming contact with a deformer 110 positioned after initiation of and during an intermediate wall-deforming step. FIG. 2*b* is a cross-sectional side view of the assembly 98 and deformer 110 shown in FIG. 2*a*, taken along line 2*b*—2*b* of FIG. 2*a*, and showing the contact surface 147 of the deformer 110 advancing toward and deforming the intermediate wall 108. FIG. 3*a* is a top view of the assembly shown in FIG. 1*a* but wherein the intermediate wall is in a deformed state following contact of the deformer with the intermediate wall. FIG. 3*b* is a cross-sectional side view of the assembly 98 shown in FIG. 3*a* with the deformer 110, with the assembly 98 being taken along line 3*b*—3*b* of FIG. 3*a*. FIG. 3*b* shows the contact surface of the deformer 110 retracting from the intermediate wall 108 leaving a portion 112 in a deformed state.

As can be seen in FIG. 2*b*, the deformer 110 deforms the cover layer 104, the pressure sensitive adhesive layer 102, and the intermediate wall 108. The intermediate wall 108 gives way to the deforming force of the deformer and begins to bulge as shown at 111. After the deformer 110 is withdrawn from contact from the assembly 98, the elastically deformable cover layer 104 and pressure sensitive adhesive layer 102 rebound to return to their original orientation, however, the inelastically deformable material of the intermediate wall 108 remains deformed after withdrawal of the deforming force such that intermediate wall 108 is provided with a depressed, deformed portion 112. The portion of the elastically deformable cover layer 104, including the pressure sensitive adhesive layer 102, adjacent the deformed portion 112 of the intermediate wall 108, is not in contact with the deformed portion 112 such that a through-passage 109 is formed allowing fluid communication between recesses 106 and 107.

According to various embodiments, the assembly can be disk-shaped, card-shaped, or have any other suitable or appropriate shape, the specific shape being suitably adaptable for specific applications. The device can be shaped to provide a series of generally linearly extending chambers that can be connected to one another according to embodiments of the present invention. For example, series of chambers can be provided in assemblies according to various embodiments whereby centripetal force can be applied to the assembly to move a fluid sample from one chamber of a series to a subsequent chamber in the series, by centripetal force. For example, disk-shaped devices having radially-extending series of chambers are provided according to various embodiments.

The assembly can be sized to be conveniently processed by a technician and can have a length, for example, of from about one inch to about ten inches. Depending upon the number of series of chambers or configuration desired, the assembly can have any appropriate size. Disk-shaped assemblies can have diameters from about one inch to about twelve inches, such as, from about four inches to about five inches. The assembly can have any suitable thickness. The thickness can be from about 0.5 millimeter (mm) to about 1 centimeter (cm) according to some embodiments. A card-shaped rectangular device having a length of from about two inches to about five inches and a width of from about one inch to about three inches, and a thickness of from about 1 mm to about 1 cm is exemplary.

The substrate layer of the assembly can include a single layer of material, a coated layer of material, a multi-layered material, and combinations thereof. An exemplary substrate is made up of a single-layer substrate of a hard plastic material, such as a polycarbonate compact disk.

Plastics that can be used for the assembly, particularly for the substrate, a base layer, a recess-containing layer, or any combination thereof, include polycarbonate, polycarbonate/ABS blends, ABS, polyvinyl chloride, polystyrene, polypropylene oxide, acrylics, polybutylene terephthalate and polyethylene terephthalate blends, nylons, blends of nylons, and combinations thereof. In particular, polycarbonate substrates can be used. The substrate can include a polyalkylene material, a fluoropolymer, a cyclo-olefin polymer, or a combination thereof, for example. One particularly useful material for the substrate is ZEONEX, a cyclo-olefin polymer available from ZEON Corporation Tokyo, Japan.

The entire substrate can include an inelastically deformable material, or at least the substrate includes an intermediate wall that is inelastically deformable. While some elasticity can be exhibited by the intermediate wall, the intermediate wall can preferably become deformed sufficiently to enable fluid communication between the two recesses that the intermediate wall separates. According to various embodiments, the assembly substrate can include a material, for example, glass or plastic, that can withstand thermal cycling at temperatures back-and-forth between 60° C. and 95° C., as for example, are used in polymerase chain reactions. Furthermore, the material should be sufficiently strong to withstand a force necessary to achieve manipulation of a fluid sample through the assembly, for example, centripetal force necessary to spin and manipulate a sample within the assembly.

The substrate layer can include one or more base layers that support and contact the recess-containing layer. The recess-containing layer can be a layer having holes formed therethrough, and a base layer can be included to contact the recess-containing layer and define bottom walls of through-hole recesses in the substrate. The substrate can have the same dimensions as the assembly and can make-up a major portion of the size of the assembly.

According to various embodiments, an assembly is provided with an elastically deformable cover layer, that at least covers portions of the recess-containing substrate layer in areas where a portion of the substrate layer is to be deformed. For example, the cover layer can cover any number of a plurality of chambers serially aligned, or all of the chambers. The cover layer can partially cover one or more chambers, inlet ports, ducts, and the like. The cover layer can have elastic properties that enable it to be temporarily deformed as a deformer contacts and deforms an intermediate wall, for example, underneath the cover layer. Once the deformer is removed from contact with the assembly, the inelastically deformed intermediate wall remains in a deformed state for at least an amount of time sufficient to enable fluid transfer between two or more recesses that are made to be in communication by deformation of the intermediate wall. The inelastically deformable material of the intermediate wall can be elastic to some extent, but if so should remain at least partially deformed after deformation for at least about 5 seconds, for example, for at least about 60 seconds. The intermediate wall can remain deformed for 10 minutes or more, or can be permanently deformable.

The elastically deformable cover layer, on the other hand, has greater elasticity than the intermediate wall and can return substantially to its original state after deformation to thereby result in the formation of a fluid communication between the two or more recesses. The elastically deformable cover layer can more or less return to an original orientation to an extent sufficient to achieve fluid communication between underlying recesses brought into communication by deformation of an intermediate wall. However, the elastically deformable cover layer does not necessarily have to be completely elastic, but should be sufficiently elastic to rebound a distance that is greater than about 25% of its deformed distance, for example, greater than about 50% of its deformed distance. For instance, if the elastically deformable cover layer has a surface that is originally in contact with an underlying intermediate wall, and is deformed at the contact area to be depressed a distance of 1.0 mm in a direction toward the intermediate wall, the elastically deformable cover layer can rebound, at the contact area after deformation, a distance of at least about 0.25 mm in a direction away from the deformed underlying intermediate wall. The elastically deformable cover layer can have an elasticity that enables it to rebound after deformation to about one hundred percent of its original orientation.

The elastically deformable cover layer can be chemically resistant and inert, as can be the substrate layer. The elastically deformable cover layer can be selected to be able to withstand thermal cycling, for example, back-and-forth between about 60° C. and about 95° C., as may be required for polymerase chain reactions. Any suitable elastically deformable film material can be used, for example, elastomeric materials. The thickness of the cover layer should be sufficient for the cover layer to be deformed by the deformer as required to re-shape an intermediate wall beneath the cover layer. Under such deforming, the elastically deformable cover layer should not puncture or break and should substantially return to its original orientation after deforming an underlying intermediate wall.

PCR tape materials can be used as or with the elastically deformable cover layer. Polyolefinic films, other polymeric films, copolymeric films, and combinations thereof can be used, for example, for the elastically deformable cover layer.

The cover layer can be a semi-rigid plate that bends over its entire width or length or that bends or deforms locally. The cover layer can be from about 50 micrometers (μm) to about 100 μm thick and a glue layer, if used, can be from about 50 μm to about 100 μm thick.

The glue or adhesive layer, for example, layer 102 or layer 122 depicted in FIGS. 1*a*–6*b*, can be any suitable conventional adhesive. For example, pressure sensitive adhesives can be used. Silicone pressure sensitive adhesives, fluorosilicone pressure sensitive adhesives, and other polymeric pressure sensitive adhesives can be used for the glue layer 102. A heat-sealing adhesive can be used and can be heated with a heater, for example, a heating bar, so that the heat-sealing adhesive can fill-in an opening or communication, for example, to close a valve or close a communication. The heater can be included in a system or apparatus for processing the microfluidic device. The heater can be the same heater as, or a different heater than, a heater used for heating a PCR chamber in the microfluidic device. According to various embodiments, no adhesive layer is used in the assembly.

The adhesive layer can have any suitable thickness and preferably does not deleteriously affect any sample, desired reaction, or treatment of a sample processed through the assembly. The adhesive layer can be more adherent to the elastically deformable cover layer than to the underlying inelastically deformable material, and can rebound with the elastically deformable cover layer.

According to various embodiments, the intermediate wall can have a height that is about equal to the depth of the deepest recess it separates. The top of the intermediate wall can be flush with the top surface of the recess-containing layer of the assembly. The intermediate wall can be formed by forming recesses in a uniform thick substrate layer whereby an intermediate wall results between the two formed recesses. The intermediate wall can be of sufficient height in a non-deformed state to contact and form a fluid-tight seal with the elastically deformable cover layer, thereby preventing fluid communication between two recesses separated by the intermediate wall. The intermediate wall can entirely be made-up of, or include only a portion that is, a deformable material. According to various embodiments, only a portion of the intermediate wall is deformed to cause a fluid communication between two recesses that the intermediate wall separates.

Assemblies according to various embodiments can include two or more recesses or chambers separated by an intermediate wall, and inlet and/or outlet ports to access the recesses or chambers. Inlet and outlet ports can be provided through a top surface of the assembly, through a bottom surface of the assembly, through a side edge or end edge of the assembly, through the substrate, through the cover layer, or through a combination of these features. For example, the assembly can include an inlet port through an elastically deformable cover layer and in communication with a first chamber of the assembly. The assembly can include an outlet port through the elastically deformable cover layer and in communication with a second chamber of the assembly. The inlet port can be designed for loading sample into the second chamber by capillary action, by gravity, by force such as elevated pressure or centripetal force, and the like. The outlet port can be designed to enable venting of gas from the second chamber, that is displaced by sample that enters the second chamber. The outlet port can be designed to enable extraction of a sample from the second chamber, for example, as by capillary action, pipetting, gravity-induced drainage, force such as centripetal force, elevated pressure, or the like. Extraction can be useful, for example, for further analysis of the extracted sample or for re-use of the assembly.

According to various embodiments, an assembly is provided that instead includes, or further includes, a recess having an inelastically deformably wall portion that can be deformed to make a barrier blocking communication between two portions of the recess. The entire side wall of the recess, or only a portion of the sidewall, can include inelastically deformable material. Such an embodiment is exemplified in FIGS. 4*a*–6*b*. Assemblies containing such features can be made of the same materials, and of the same dimensions and shapes, as are discussed above with reference to various embodiments including at least two recesses separated by an intermediate wall.

FIG. 4*a* is a top view with partial cutaway of a microfluidic assembly according to an embodiment wherein a substrate is comprised of a recess that can be divided into two recessed portions.

FIG. 4*b* is a cross-sectional side view of the assembly shown in FIG. 4*a*, taken along line 4*b*—4*b* of FIG. 4*a*.

FIGS. 5*a* and 5*b* show the deformer positioned at the initiation of an opposing wall surface portion-deforming step, and the contact surface of the deformer advancing toward the deformable opposing wall surface portions.

FIGS. 6*a* and 6*b* show the assembly shown in FIG. 4*a* following contact of the deformer with the opposing wall surface portions.

In FIGS. 4*a*–6*b*, the assembly 119 includes a substrate 120, a pressure sensitive adhesive layer 122, an elastically deformable cover layer 124, a recess 126, and a recess sidewall 138. As can be seen in FIGS. 5*a* and 5*b*, a deformer 130 is used and includes a closing blade design having two generally conical contact surfaces 133 and 135. As shown in FIG. 5*b*, the deformer 130 is positioned such that the contact surfaces 133 and 135 deform areas of the inelastically deformable substrate 120, on opposing sides of the recess 126. In the embodiment shown in FIGS. 4*a*–6*b*, the entire substrate 120 is made up of an inelastically deformable material, such as polycarbonate, and the sidewall 138 of the recess 126 is entirely made of inelastically deformable material. According to various embodiments, a coating (not shown) can be applied to the sidewall 138 of the recess 126, for example, to effect surface tension properties, to render the sidewall 138 chemically resistant or more chemically resistant, to render the sidewall 138 inert or more inert, or to otherwise alter one or more physical, mechanical, or chemical characteristics of the sidewall 138.

Similar constructions materials, dimensions, and other properties described with reference to FIGS. 1*a*–3*b* also apply to the embodiment of FIGS. 4*a*–6*b*.

As shown in FIG. 5*b*, the non-labelled arrows show the direction of advancement of the deformer 130 toward the assembly 119. After full advancement and completion of the deforming step, the deformer 130 and the assembly 119 are separated from each other and the resulting deformed assembly is as shown in FIGS. 6*a* and 6*b*. The contact surfaces 133 and 135 of the deformer 130 (FIG. 5*b*) deform the assembly 119 so as to form two impressions 134 and 137 in the substrate 120. Formation of the impressions 134 and 137 causes a bulging inelastic deformation of the inelastically deformable substrate 120 in directions from each impression toward the other. The deformation resulting from causing depressions 134 and 137 causes deformation of a barrier wall 132 that interrupts fluid communication between a first portion 140 of recess 126, and a second portion 142 of recess 126. As can be seen in FIG. 6*b*, after deformation to form the barrier wall 132, the elastically deformable cover layer 124 including the attached pressure sensitive adhesive layer 122, elastically rebound to their original orientations whereby the barrier wall 132 contacts the pressure sensitive adhesive layer 122 to cause a fluid-type seal therebetween that interrupts fluid communication between the two portions 140 and 142 of the recess 126.

According to various embodiments, the assembly can be provided with series of chambers that can be made in communication with adjacent chambers or blocked from adjacent chambers, according to deforming methods. The assemblies can include linear series of multiple chambers, that can optionally include differently sized channels for connecting, and blocking communication between, adjacent chambers. The chambers, channels, or both, can each independently be empty, loaded with a reactant, agent, solution, or other material, or be provided with, for example, filtration media and/or frits. The assembly can be provided with an inlet or entrance port for each series of reaction chambers, and can include a plurality of reaction chambers. Exemplary assemblies can include 48 or 96 series of reaction chambers, with each series having an independent inlet port. One or more outlet ports for each series of chambers can be provided or formed in the assembly before or after a sequence of treatments or reactions occur through the series, for example, according to various embodiments. An exemplary configuration includes a splitter to divide a sample through a series of chambers whereby a portion of the sample continues along a first flowpath and involves a forward sequencing reaction, and the remainder of the sample follows a second flowpath and involves a reverse sequencing reaction. In such splitting configurations, two respective outlet ports can be provided in product collection wells for analysis of forward-sequenced and reverse-sequenced products. The various chambers of the series according to various assemblies can be of different sizes and capacities. For example, purification chambers can have longer lengths and larger capacities than sequencing reaction chambers and a polymerase chain reaction chamber can have double the capacity of the forward-sequencing and the reverse-sequencing chambers. A PCR chamber can be provided in a series according to various embodiments, wherein the PCR chamber is preloaded with PCR reactants sufficient to enable a desired amplification of a nucleic acid sequence.

The series of chambers can include one or more purification chambers, for example, a purification downstream of a PCR chamber and prior to one or more sequencing reaction chambers. An additional, or alternative embodiment provides an assembly whereby one or more purification chambers are provided downstream of one or more respective sequencing reaction chambers in a series of chambers. If sequencing reaction chambers are provided, they can be preloaded with sequencing reaction reactants that enable a desired forward, reverse, or both forward and reverse sequencing reaction or group of reactions. Other pre-loaded components can include buffers, marker compounds, primers, and other components as would be recognized as suitable by those skilled in the art.

Figures 31, 32, 33, 34, 35, 36:
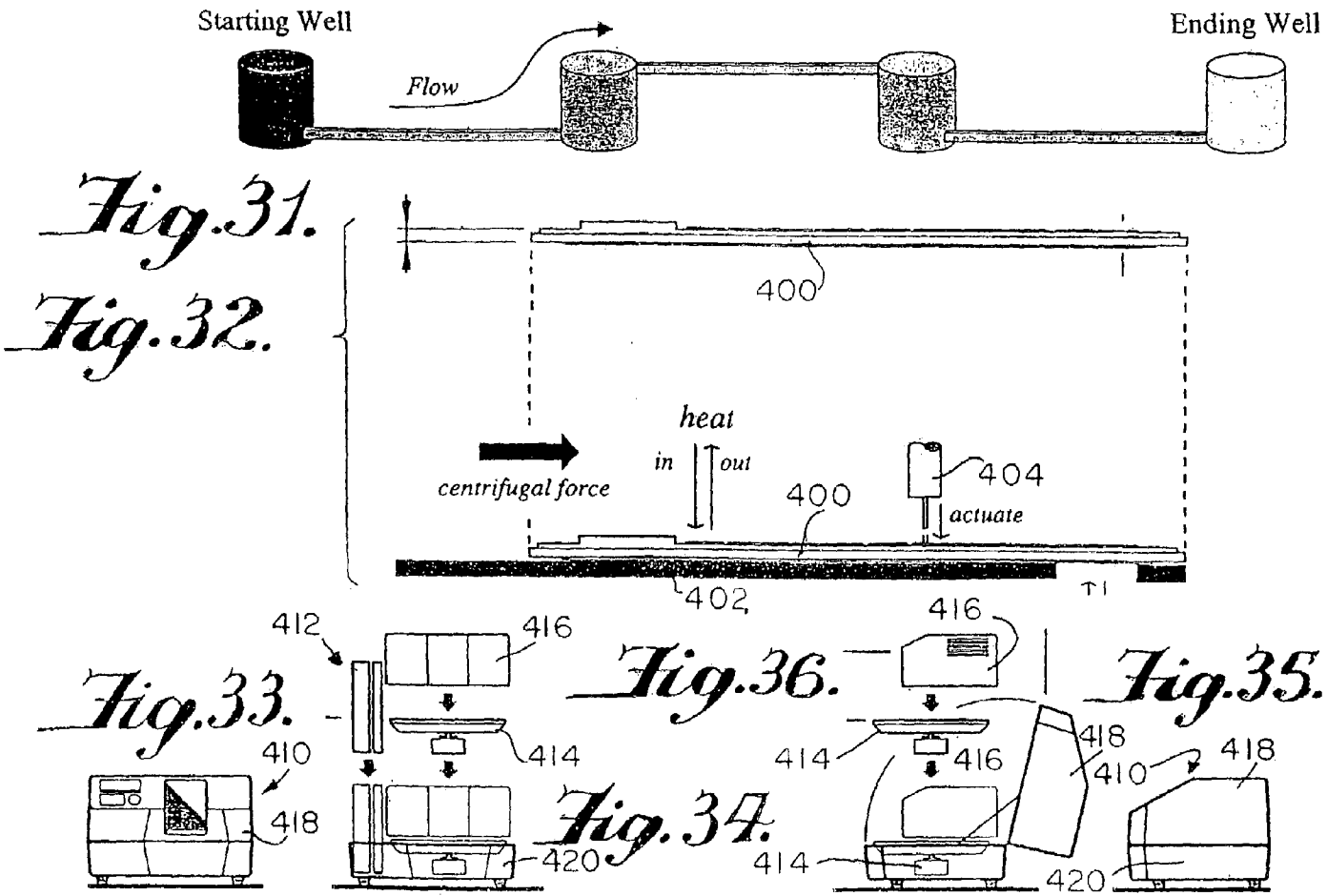
FIG. 31 is a perspective view of an exemplary flow path through an exemplary device according to various embodiments.
FIG. 32 is a side view of an assembly according to an embodiment, and resting on a support in a system that provides centripetal force, heating, and valving.
FIG. 33 is a front view of an exemplary system that can be used to process assemblies such as shown in FIG. 17, to carry out the methods depicted in FIGS. 20–26.
FIG. 34 is an exploded view of the system shown in FIG. 33, in partial phantom, with the top cover removed.
FIG. 35 is a side view of the device shown in FIG. 33.
FIG. 36 is an exploded view in partial phantom of the device shown in FIG. 35 with the cover open.
Figure 39:
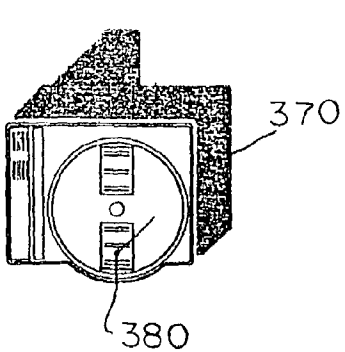
FIG. 39 is an enlarged view of a section of the system shown in FIG. 33 partially cutaway to show the two-assembly platen.
Figure 38:
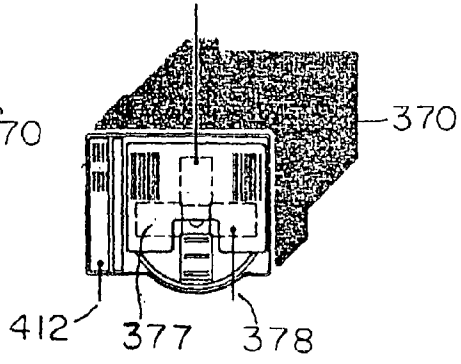
FIG. 38 is an enlarged view of a portion of the system shown in FIG. 33, depicting the positions of the valve actuators, heaters, and electronics.
Figure 37:
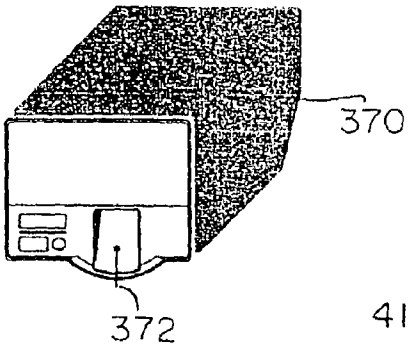
FIG. 37 is an enlarged view of the assembly loading door of the system shown in FIG. 33.

Different levels and layers of channels and chambers can be included in assemblies according to various embodiments. For example, a tiered, multi-channel assembly can be provided that includes flow pathways that traverse different heights or levels in the substrate. An assembly including a tiered three-channel series is illustrated with reference to FIG. 31. FIG. 31 is a perspective view of an exemplary flow path through an exemplary device according to various embodiments. FIG. 31 is a schematic drawing showing the flow pathway of a fluid that is manipulated from a schematically-illustrated starting well to a schematically-illustrated ending well. As can be seen in FIG. 31, the pathway includes a flow of fluid from the starting well, through a lower channel, up a duct and through an upper channel, down a duct and through a second lower channel to the ending well.

According to various embodiments, a system is provided that includes a support for supporting an assembly according to various embodiments, and a deformer that contacts the supported assembly and deforms at least one intermediate wall, at least one deformable side wall, or any combination thereof, of the assembly. The system can be provided with a positioning unit for registering the area of the assembly to be deformed, with the deformer. Precision positioning drive systems can be used to enable the deformer and the assembly to be moved relative to one another such that the feature of the assembly to be deformed is aligned and registered with the deformer.

According to various embodiments, the deformer can have any of a variety of shapes, for example a shape that leaves an impression in the inelastically deformable material that results in a fluid communication or a barrier wall breaching communication, between two recesses or recessed portions of the assembly. The deformer can have an opening blade design that, when contacted with an assembly in a deforming step can form a communication between two recesses of the assembly by deforming an intermediate wall that separates the two recesses. A straight edge, chisel-edge, or pointed-blade design, for example, can be used to form a trough or other channel for providing a fluid communication between the two recesses.

According to embodiments wherein the deformer includes one or more features that deform an inelastically deformable sidewall of a recess into a barrier wall. For example, a deformer having two points that contact the assembly on opposite sides of a fluid communication channel, can be used to deform the sidewalls of the channel adjacent the deformer points and thereby cause the formation of a dam or barrier wall between the two portions of the recess resulting from the deformation.

The deformer can include, for example, both a closing feature and an opening feature that together can simultaneously interrupt a communication and form a new communication in a single deforming action.

The system according to various embodiments can include a variety of deformers, for example, one or more opening blade deformer and one or more closing blade deformer. Such systems can be used in connection with processing assemblies that include at least one series of chambers, one or more of which is in fluid communication with another, and one or more of which is separated from another by a barrier wall. More details about various systems are set forth below.

According to various embodiments, methods are provided for forming a fluid communication between two recesses of an assembly having at least two recesses separated by at least one intermediate wall. The method includes inelastically deforming the intermediate wall to form a fluid communication between the at least two recesses. More specifically, the method includes contacting the elastically deformable cover layer of the assembly with a deformer, and forcing the assembly and deformer into contact under sufficient force to deform the intermediate wall with the deformer, through the elastically deformable cover layer. After inelastic deformation of the intermediate wall, the deformer is removed from contact with the elastically deformable cover layer and the elastically deformable cover layer returns to its original, pre-deformed, shape. The resulting structure of the assembly thereby changes to cause a space between the elastically deformable cover layer and the underlying, deformed, intermediate wall. The intermediate wall can be in contact with the elastically deformable cover layer, to form a fluid-tight seal, when the intermediate wall is in a non-deformed state.

According to various embodiments, methods are provided for forming a barrier wall to interrupt fluid communication between two recessed portions of an assembly according to various embodiments. According to such methods, at least one of the two recessed portions is partially defined by or has a sidewall made of an inelastically deformable material that can be deformed into the shape of a barrier wall between the two recessed portions of the assembly. According to such embodiments, a closing blade configuration can be used with a deformer to effect the formation of the barrier wall. The barrier wall can be made by the deformation of opposing side walls of a recess or of at least one recessed portion of two communicating recessed portions.

According to various embodiments, after an assembly has been deformed to form a fluid communication or to form a barrier wall, the deformed assembly can then be treated or processed to achieve a product, for example, a reaction product or a purification product. Methods of manipulating the flow of fluids and other components within various chambers of a series of chambers can be effected by, for example, centripetal force, electrical forces such as are used in electrophoresis or in electroosmosis, pressure, vacuum, gravity, centripetal force, capillary action, or by any other suitable fluid manipulating technique, or combination thereof. As a result of a fluid manipulation step, the manipulated fluid can be reacted in a newly-entered chamber, for example, by polymerase chain reaction under thermal cycling conditions, by a sequencing reaction under specified thermal conditions, by purification, and/or by any combination of treatments.

According to various embodiments, a microfluidic manipulation system is provided having a fluid manipulation assembly, an assembly support, a deformer, and a positioning unit. The fluid manipulation assembly can be any of the assemblies desired herein, for example, an assembly that has a substrate layer, at least two recesses formed in the substrate layer, and at least one intermediate wall wherein the intermediate wall separates a first recess from a second recess, and the intermediate wall includes a deformable inelastic material. The deformer can contact a surface of the assembly, with the cover layer in between, that is more resistant to deformation than the deformable inelastic material of the intermediate wall. The positioning unit is adapted to position the deformer relative to the fluid manipulating assembly, when the fluid manipulating assembly is supported by the assembly support, such that the deformer can be forced to deform the deformable inelastic material to form a fluid communication between the first recess and the second recess.

A further feature is a microfluidic manipulation system having a fluid manipulating assembly, an assembly support platform, a deformer, and a positioning unit, where the fluid manipulating assembly has a substrate layer and at least one recess formed in the substrate layer and having a first portion and a second portion in fluid communication with one another in a non-deformed state of the assembly. The recess is at least partially defined by one or more recess wall surface that includes a deformable inelastic material.

The system can be configured to enable the deformer to deform the deformable inelastic material to form a barrier wall between the first recess portion and the second recess portion. A barrier can be produced that can, for example, prevent fluid communication between the portions when the barrier wall is in a deformed state.

The deformer can have one or more contact surface that is more resistant to deformation than the deformable inelastic material. The positioning unit of the system can be adapted to position the deformer relative to the fluid manipulating assembly, when the fluid manipulating assembly is on the assembly support platform. The deformer can include a closing blade and can be manipulated to be forced to deform the deformable inelastic material into a barrier wall. The barrier wall can be of sufficient dimensions to interrupt fluid communication between the two recessed portions of the assembly.

The systems can be provided with an appropriate control unit to control the relative positioning between the deformer and an assembly supported by the assembly support. The control unit can include programmable software, hardware, or both, that can control positioning, control the deforming action of the deformer, and control the application of fluid manipulating forces to an assembly supported by the assembly support. For example, the control unit can control rotation and the application of centripetal force to an assembly, including, starting rotation, ending rotation, and the rate of rotation during the actuation period. Suitable controls including registration systems are taught, for example, in PCT published Application No. WO 97/21090 and WO 99/34920, which are hereby incorporated in their entireties by reference. Such electronics can be housed in a singular unit and the unit can be housed in an assembly, for example, along with heating devices, centripetal force devices, supports, and other components as would be recognized by those skilled in the art.

The control unit can also be controllable to selectively decide between various pathways of fluid flow through assemblies according to various embodiments. All, or many, of the method steps used according to various embodiments can be controlled by the control unit. The control unit can be programmed, for example, to carry out a sequence of steps such as a spinning step, a deforming step, a heating step, a deforming step, a purification step, and a sample collection step, in sequence.

In the foregoing various embodiments, the deformer, positioning unit, and the assembly support platform, can be replaced by various other means for deforming, means for positioning, and means for supporting the assembly, respectively.

According to various embodiments, a system is provided that can include an apparatus that analyzes, sequences, detects, or otherwise further treats, processes, or manipulates a sample or reaction product in an assembly as described herein. Various analyzers, detectors, and processors that can be used include: separation devices, including electropheretic, electroosmotic, or chromatographic devices; analyzing devices, including nuclear magnetic resonance (NMR) or mass spectroscopy devices; visualizing devices, including autoradiographic or fluorescent devices; recording or digitizing devices, such as a camera, a personal computer, a charged coupled device, or x-ray film; or any combination of the above apparati.

According to exemplary method embodiments involving the use of a system as described herein, a sample can be treated as follows. First, a sample reagent, or wash solution, can be dispensed into an inlet port or inlet chamber of an assembly as described herein. Dispensing can be accomplished by a robot, or manually, at any suitable time during the process, for example, at the beginning of the process. A sample access hole can be provided. The assembly can be spun to move fluid sample from one chamber to an adjacent chamber through a fluid communication. Spinning can be used to force fluid through a purification medium. Fluid communications between various chambers can be selectively opened and closed through the deforming steps described herein to effect fluid transfer or fluid isolation. Mixing of fluid can be accomplished by a variety of means, for example, an external ultrasonic actuator or by oscillating a stepper motor. Time and temperature controls can be provided so that the assembly can be subjected to an incubation period. Heating elements and cooling elements can be provided as part of a temperature control unit.

The methods can also include detecting a product processed in an assembly as described herein using a method and system as described herein. Detection can be accomplished by a system described herein or by implementing any of various independent detection systems.

Processed fluids can be preserved in the assembly, stored, or removed from the assembly, for example, by pipetting or washing-out.

FIG. 7 is a perspective view of a deformer and substrate according to an embodiment wherein a fluid communication can be formed. As shown in FIG. 7, an opening blade 144 for a deformer according to various embodiments, is provided. The opening blade design of opening blade 144 can be used to form a v-shaped recess, trough, through-passageway, or fluid communication 150 as shown in a substrate 146 that has been deformed with the opening blade 144. In the embodiment shown in FIG. 7, the sidewall 148 of the fluid communication 150 is made of the same inelastically deformable material that makes up the substrate 146.

The opening blade 144 of FIG. 7 can have a variety of sizes. For example, the opening blade 144 can have a thickness of about one millimeter, a length of about three mm, and the deformer contact surface edge 145 can be rounded with a radius of about 50 micrometers.

FIG. 8 is a perspective view of a deformer mounted on a system according to an embodiment wherein the deformer has a plurality of screws to fix the deformer to the microfluidic manipulation system.

FIG. 8 shows an opening blade 152 having a flat contact surface 153 and tapering edges 155 and 157 that lead to the contact surface 153. The blade 152 can be mounted on a blade support, for example, that is integral with a positioning unit, and held in place in the blade support by rails 156 and 159 and set screws 151 and 154.

FIGS. 9–11 are perspective views of deformers and substrates according to embodiments wherein a fluid communication channel having at least one opposing wall surface portion comprised of deformable inelastic material can be interrupted by a barrier wall formed from the deformer. In FIGS. 9–11, three different closing blade configurations 158, 166, and 168, are shown. Each closing blade 158, 166, and 168 is shown disposed above an inelastically deformable substrate 160 having a fluid communication 162 formed therein and having a sidewall 164. The elastically deformable cover layer and pressure sensitive adhesive layer (effused) are not shown in FIGS. 9–11 for the sake of simplicity.

Due to the deformation of the substrate 160 upon deforming contact of the substrate with any of the closing blade configurations 158, 166, and 168 results in a bulging deformation that causes a barrier wall to form, interrupting communication between the two portions of communication 162 that become separated by the barrier wall. The closing blades 158, 166, and 168 can have a variety of sizes. For example, the cutting portions 159, 165, and 169 of the closing blades 158, 166, and 168, respectively, of FIGS. 9–11 can have a thickness of about 0.2 millimeter and a width of about one millimeter.

FIG. 12 is a perspective view of a deformer and system according to an embodiment as described herein wherein the deformer has a plurality of contact surfaces and a plurality of screws to fix the deformer to the microfluidic manipulation system. In FIG. 12, a deformer 172 is shown having a closing blade design. The closing blade design is provided by a combination of two deforming blades 170 and 171 separated at the tips 173 and 175, respectively, thereof. As can be seen in FIG. 12, a gap exists between tips 173 and 175. The deforming blades 170 and 171 are held securely within rails 179 and 181 and set screws 176 and 177 of the deformer 172. Second set screws 174 and 183 can be provided to further secure deforming blades 170 and 171.

Figure 13B:
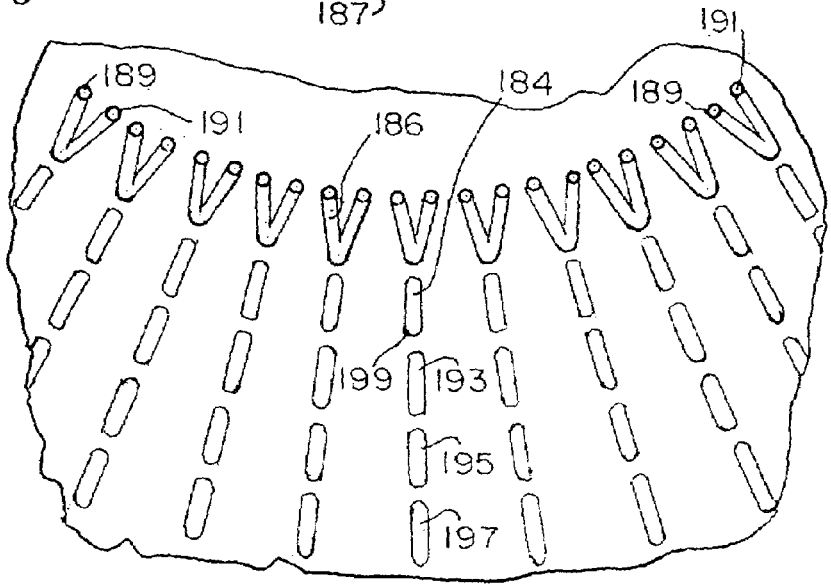
FIG. 13*b* is an enlarged view of a section of the disk-shaped fluid manipulating assembly shown in FIG. 13*a;*

FIG. 13*a* is a top view of a disk-shaped fluid manipulating assembly according to an embodiment showing a plurality of radially extending series of recesses in the substrate. FIG. 13*b* is an enlarged view of a section of the disk-shaped fluid manipulating assembly shown in FIG. 13*a*. FIGS. 13*a* and 13*b* show a disk-shaped assembly according to an embodiment. The assembly 180 includes a substrate 183, a pressure sensitive adhesive layer 185, and a cover layer 187. The assembly includes a central hole 188 to facilitate supporting the assembly on a positioning and/or support unit (not shown). The assembly includes a plurality of v-shaped vented inlet chambers 186, each of which is provided with an inlet port 189 and an exhaust vent 191 (FIG. 13*b*). The assembly 180 includes a plurality of series of chambers, one series corresponding to each of the v-shaped inlet chambers 186. FIG. 13*b* shows one exemplary series of chambers, wherein the assembly is in a non-deformed state and the chambers 184, 193, 195, and 197 are each isolated and not in fluid communication with any of the other chambers of the series. As can be seen in FIG. 13*b*, intermediate walls exist, for example, at 199, between the adjacent chambers of the series. The assembly 180 can be processed with a system as described herein to selectively deform the intermediate walls 199 and build barrier walls (not shown) so as to enable the flow of a fluid sample through the series of chambers. Centripetal force can be used by spinning the assembly 180 to effect radial movement of fluids through the series of chambers.

Figure 14:
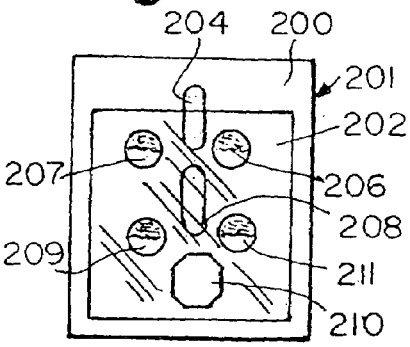
FIG. 14 is a top view of a microfluidic assembly according to an embodiment and including a recess of a plurality of recesses that is only partially covered by an elastically deformable cover layer.

FIG. 14 is a top view of a microfluidic assembly according to an embodiment and including a recess of a plurality of recesses that is only partially covered by an elastically deformable cover layer. FIG. 14 shows an exemplary fluid manipulation assembly 201 according to an exemplary embodiment. The fluid manipulation assembly 201 includes a substrate 200 made of an inelastically deformable material, and a cover 202. An inlet chamber 204 is provided that is partly covered by the cover 202. Intermediate walls exist between inlet chamber 204 and chambers 206, 207, and 208. Chambers 206 and 207 are filled with different reagents. According to what flowpath is desired, a sample can be introduced in inlet chamber 204, and manipulated into mixture with the contents of chambers 206, 207, or both 206 and 207, according to methods and with the use of systems as described herein. From chamber 206 or 207, a fluid sample can then be made to flow into chamber 208 as by deforming substrate 200 to cause a fluid communication to chamber 208. Depending, for example, on an observation about the fluid in chamber 208, a fluid communication can then be formed from chamber 208 into either of reagent-containing chambers 209 or 211, or straight into collection chamber 210. The end of the flowpath of a sample through the fluid manipulation assembly 201 can be at collection chamber 210. After passing from one chamber to another in the assembly, the system can also be used to deform the substrate 200 so as to form barrier walls between downstream chambers and upstream chambers. From collection chamber 210, a product can be analyzed, further purified, collected for analysis in a subsequent device, or any combination thereof.

According to various embodiments as shown in FIG. 14, chambers 206, 207, 209, and 211 can be, for example, pre-filled with a dry reagent, a wet reagent, or a combination thereof, for later use and/or analysis. After introducing a sample (not shown) into inlet chamber 204, the microfluidic assembly of FIG. 14 can be, for example, analyzed, processed, or manipulated with a system according to various embodiments described herein. A system according to an embodiment described herein can, for example, control the sequence, timing, and/or temperature of a reaction. A system according to various embodiments can also be equipped with a detection unit. Fluids from any one of inlet chambers 204, can be moved through a respective series of the chambers 206, 207, 208, 209, 210, or 211, by a force such as centripetal force, or a pressure differential generated by, for example, a piston, a roller, ultrasound, or by an electrochemical or chemical reaction. The microfluidic assembly of FIG. 14 can include at least one filter (not shown) or a frit (not shown) that captures compounds by an affinity reaction. For example, a filter can be embedded within the substrate 200 or within chamber 208.

Figure 15:
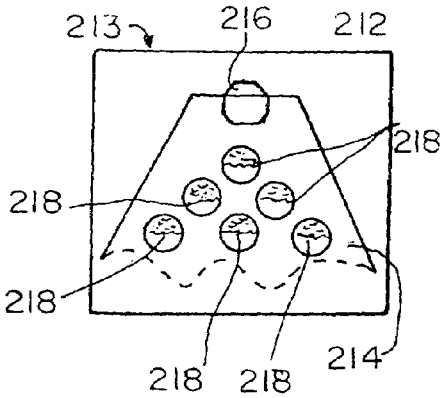
FIG. 15 is a top view of yet another microfluidic assembly according to an embodiment and including a portion of a recess that is not covered by an elastically deformable cover layer and two recesses that contain a liquid.

FIG. 15 is a top view of yet another microfluidic assembly according to an embodiment and including a portion of a recess that is not covered by an elastically deformable cover layer and two recesses that contain a liquid. FIG. 15 shows another assembly 213 according to an embodiment. The assembly 213 includes a substrate 212, an inlet chamber 216, reagent-filled chambers 218, and a cover layer 214. As illustrated in FIG. 15, any of a variety of the number of chambers, size of chambers, reagents contained in the chambers, and configurations of chambers, can be used to form assemblies having various matrices according to embodiments.

The microfluidic assembly according to an embodiment as shown in FIG. 15 can, for example, contain an indicator solution that changes color depending on the composition of the sample (not shown) in a chamber 218. Based on the color of the indicator solution, a decision can be made to send the sample to one of the surrounding sample chambers 218 that can, for example, contain another, but different, reagent. The decision can be made by an operator or automatically selected by the control unit. The previous steps can be repeated many times according to various embodiments as shown in FIG. 15.

Figure 16A:
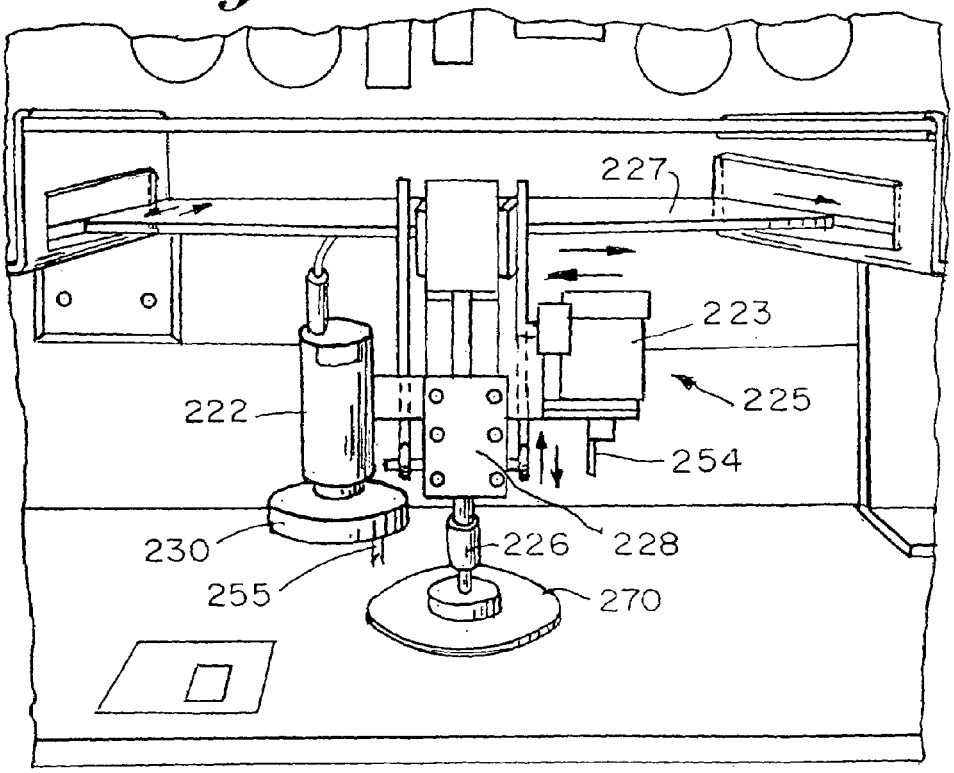
FIG. 16*a* is a perspective view of a microfluidic manipulation system according to an embodiment wherein a disk-shaped fluid manipulating assembly is disposed on an assembly support platform beneath a deformer fixed to a positioning unit.
Figure 16B:
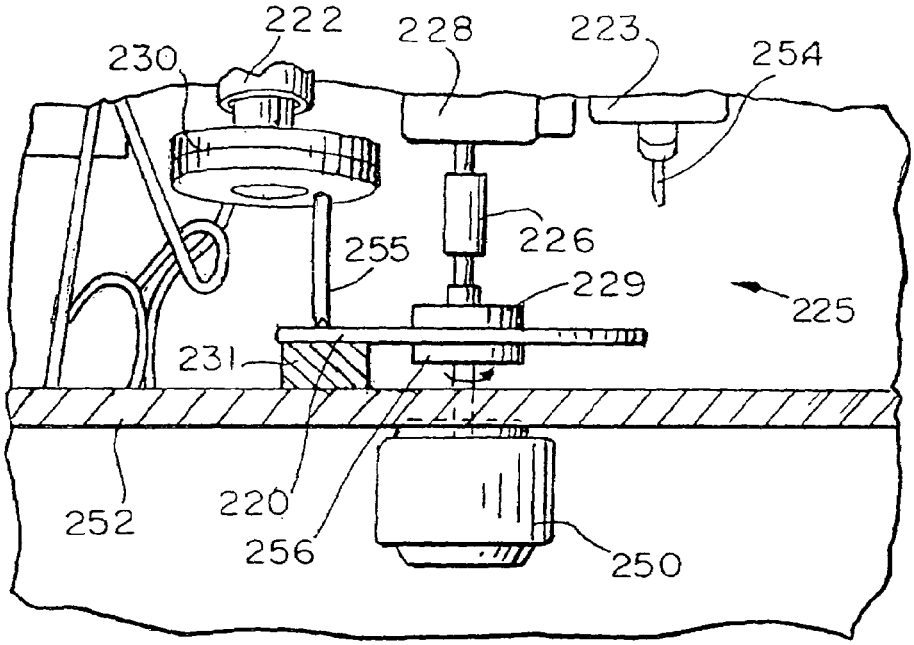
FIG. 16*b* is a side view of the microfluidic manipulation system shown in FIG. 16*a;*

FIG. 16*a* is a perspective view of a microfluidic manipulation system according to an embodiment wherein a disk-shaped fluid manipulating assembly 220 is held by supports 229 and 256 and disposed on an assembly support platform 231 beneath a deformer 255 fixed to a positioning unit 230. FIG. 16*b* is a side view of the microfluidic manipulation system shown in FIG. 16*a*. The system 225 illustrated in FIGS. 16*a* and 16*b* is shown in conjunction with a disk-shaped assembly 220 according to various embodiments. The assembly 220 is mounted for rotation about a central axis driven by a motor 250. The motor 250 includes, for rotation about its axis of rotation, a support platform 256 for supporting the assembly 220. The support 229 for supporting the assembly 220, is further connected to an overhead support system 228 that includes a mandrel 226. The positioning unit 230 includes a drive system 222 and can actuate the deformer 255 to register the deformer 255 with the assembly 220. A second positioning system 223 includes a deformer 254 in the form of an opening blade. One, or both, of the positioning units 230 and 223 can be moved relative to the assembly 220 along guided paths for precise registration with the assembly 220. Any of various rail and track arrangements 227 for enabling precision-guided movement of either or both positioning units is provided according to the system illustrated.

In FIGS. 16*a* and 16*b*, it can be seen that positioning unit 230, while being moveable along rail and track system 227, can also be rotated about a cylindrical axis thereof to further effect positioning of deformer 255 with respect to assembly 220. FIG. 16*b* also shows the platform 252 to which motor 250 is mounted.

Figure 18:
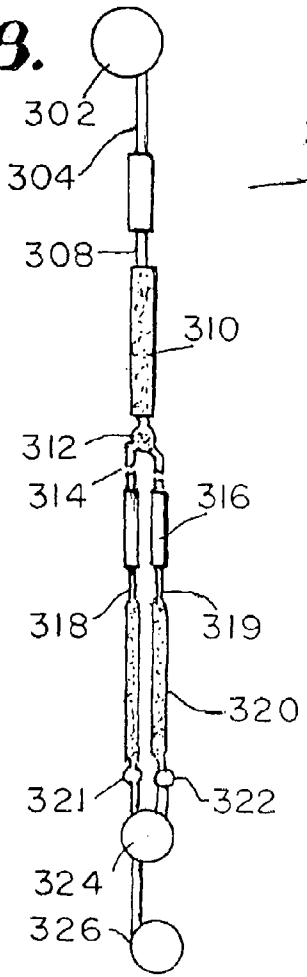
FIG. 18 is an enlarged view of the pathway shown in the assembly of FIG. 17.
Figure 17:
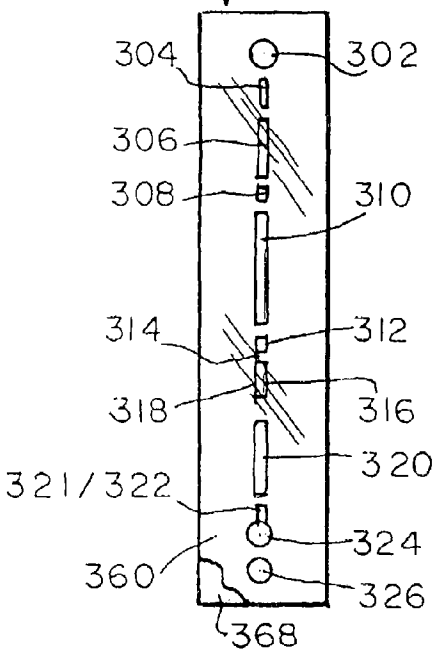
FIG. 17 is a top view of a microfluidic assembly according to an embodiment having a pathway for processing a sample.
Figure 27:
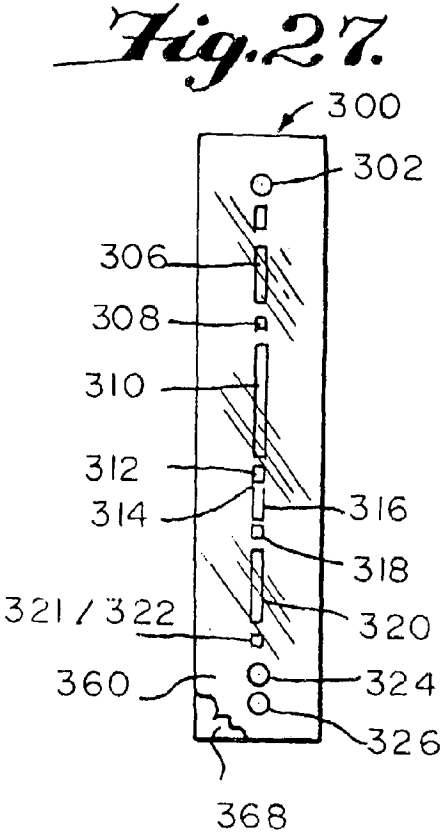
FIG. 27 is a top plan view of the assembly shown in FIG. 17 after completion of the series of method steps depicted in FIGS. 20–26.

FIG. 17 is a top view of a microfluidic assembly having a pathway for processing a sample according to various embodiments. FIG. 18 is an enlarged view of the pathway shown in the assembly of FIG. 17. Underlying channels such as channels formed on the underside of the substrate, for example, inlet valve channel 304, are not shown in the top view of FIG. 17. A sample can be processed through the assembly of FIG. 17 and the pathway shown enlarged in FIG. 18, and through the various method steps depicted in FIGS. 19–27. An exemplary cross-section taken through the assembly 300 is shown in FIGS. 28 and 29. A processed assembly is depicted in FIG. 27.

Figure 19:
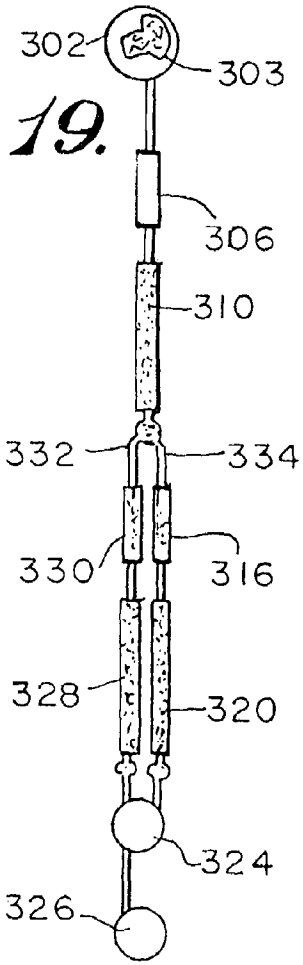
FIG. 19 is an illustration of an initial step of a method according to an embodiment using the pathway shown in FIG. 18, and showing the pathway in a beginning orientation and containing a loaded sample.

FIG. 19 is an illustration of an initial step of a method using an assembly such as shown in FIG. 17, having a pathway in a beginning orientation and containing a loaded sample.

Figures 20, 21, 22:
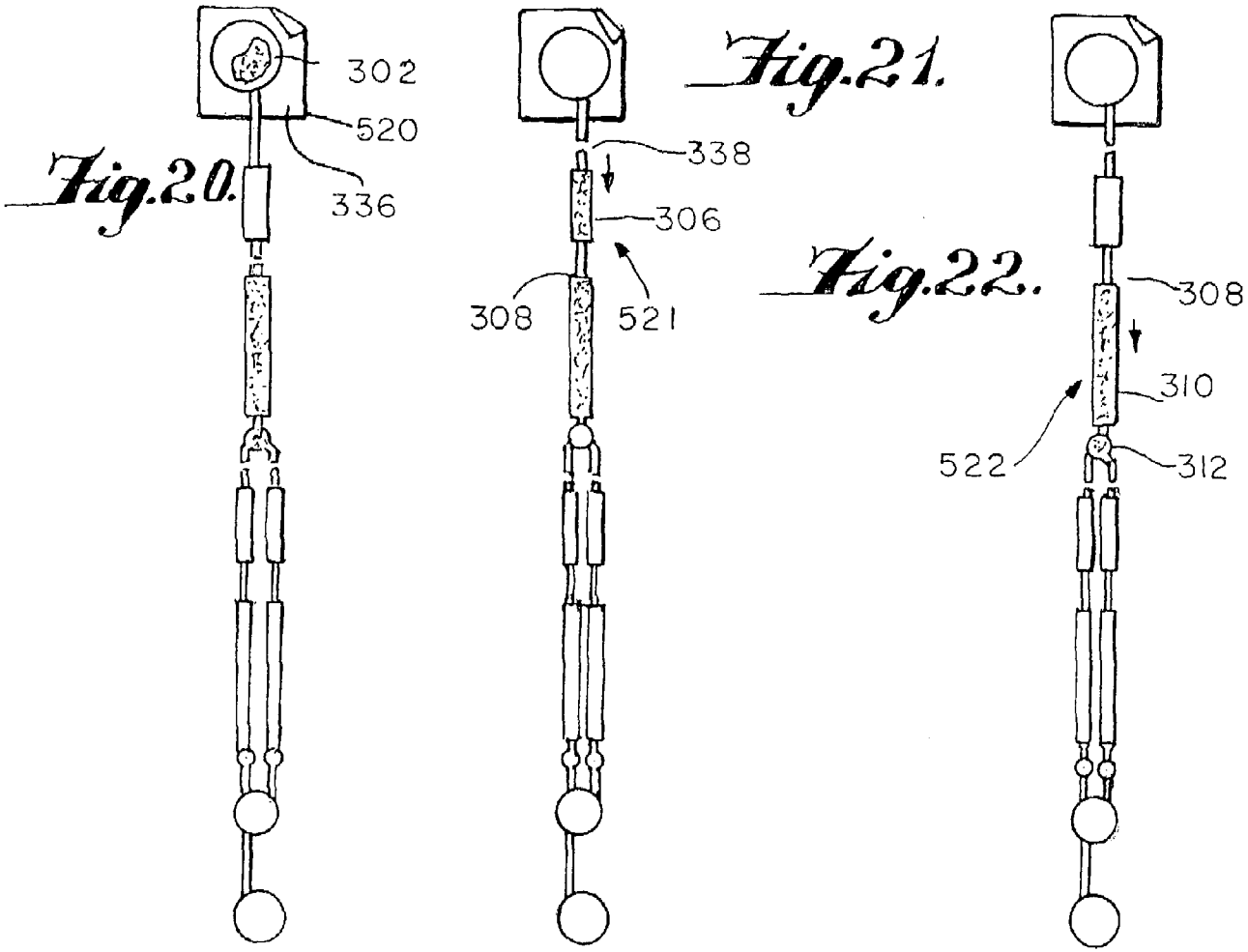
FIG. 20 is a top view of the pathway shown in FIG. 18 and the region 520 of the pathway where sample loading and sealing occurs.
FIG. 21 is a top view of the pathway shown in FIG. 18 and the region 521 of the pathway where polymerase chain reaction occurs.
FIG. 22 is a top view of the pathway shown in FIG. 18 and the region 522 of the pathway where PCR purification occurs.

FIG. 20 is a top view of the pathway of the assembly shown in FIG. 17 and the region 520 of the pathway where sample loading and sealing occurs. FIG. 21 is a top view of the pathway of the assembly shown in FIG. 17 and the region 521 of the pathway where polymerase chain reaction occurs.

Figures 23, 24, 25:
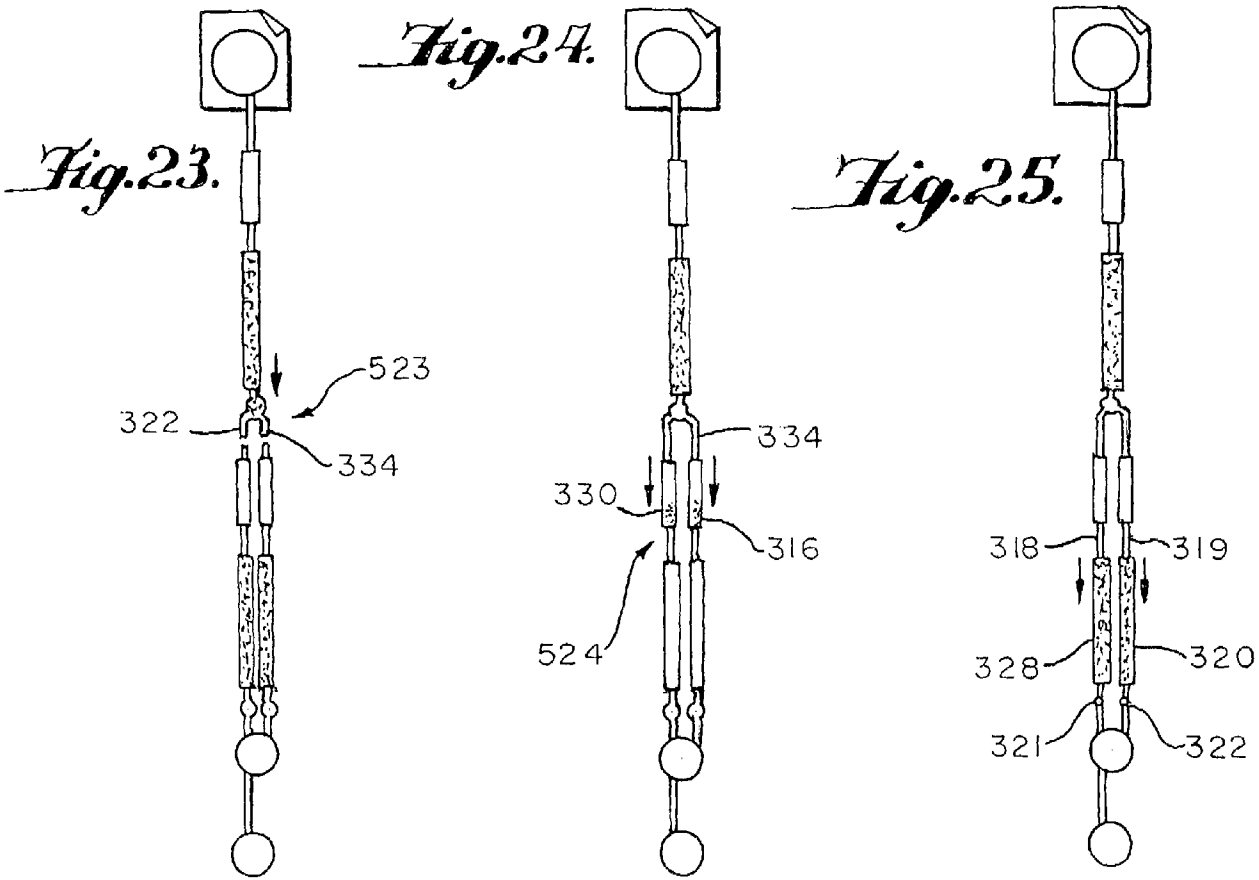
FIG. 23 is a top view of the pathway shown in FIG. 18 and the region 523 of the pathway where purification through the purification frit and forward and reverse sequencing reactions occur.
FIG. 24 is a top view of the pathway shown in FIG. 18 and the region 524 where communications are formed to open the sequencing reaction chambers and force purified PCR product into the two sequencing chambers.
FIG. 25 is a top view of the pathway shown in FIG. 18 and the region 525 of the pathway where outlets from the sequencing reaction chambers are formed and the sequencing reaction (SR) products are purified through the SR product purification columns.

FIG. 22 is a top view of the pathway of the assembly shown in FIG. 17 and the region 522 of the pathway where PCR purification occurs. FIG. 23 is a top view of the pathway of the assembly shown in FIG. 17 and the region 523 of the pathway where purification through the purification frit and forward and reverse sequencing reactions occur.

FIG. 24 is a top view of the pathway of the assembly shown in FIG. 17 and the region 524 where communications are formed to open the sequencing reaction chambers and force purified PCR product into the chamber. FIG. 25 is a top view of the pathway of the assembly shown in FIG. 17 and the region 525 of the pathway where outlets from the sequencing reaction chambers are formed and the SR product is purified through sequencing reaction product purification columns.

Figure 26:
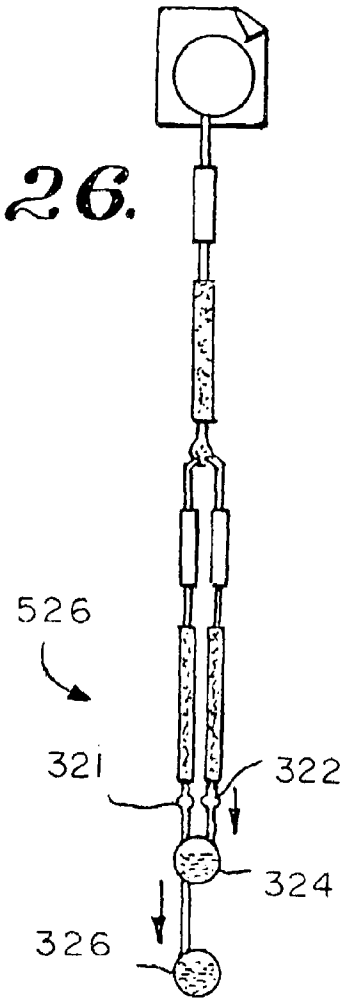
FIG. 26 is a top view of the pathway shown in FIG. 18 and the region 526 of the pathway where purified sequencing reaction product from the forward sequencing reaction and from the reverse sequencing reaction are forced into respective product collection wells.

FIG. 26 is a top view of the pathway of the assembly shown in FIG. 17 and the region 526 of the pathway where purified sequencing reaction product from the forward sequencing reaction and from the reverse sequencing reaction are forced into respective product collection wells.

FIG. 27 is a top plan view of the assembly shown in FIG. 17 after completion of the series of method steps depicted in FIGS. 20–26. FIG. 28 is a view of the assembly shown in FIG. 17 and the cross-sectional line 29—29 resulting in the partial cross-section shown in FIG. 29. FIG. 29 is a cross-sectional view taken along line 29—29 of FIG. 28.

Referring to FIGS. 17–29 and the initial state of the assembly pathway, shown in FIG. 18, and inlet chamber 302 which can be used as a polymerase chain reaction setup well, is provided. A PCR inlet channel in an open position is shown at 304. Under centripetal force, a sample input in the PCR setup well 302 can be forced through inlet channel 304 into a polymerase chain reaction chamber 306. FIG. 19 shows a sample 303 introduced into PCR setup well 302 and FIG. 20 shows the pathway of FIG. 19 after an adhesive cover tape 336 is used to seal the top of PCR setup well 302. The loading of sample 303 and sealing with the tape 336 occurs in region 520 shown in FIG. 20.

As mentioned above, centripetal force is used to force the sample 303 from chamber 302 into PCR chamber 306. As shown in FIG. 21, after the sample 303 is forced into PCR chamber 306, the chamber 306 can be sealed according to methods as described herein, from inlet chamber 302 by forming a barrier wall 338 with a deformer (not shown), between chambers 302 and 306. The movement into the PCR chamber 306 and the formation of barrier wall 338 occur in region 521 of the pathway, shown in FIG. 21.

After the assembly is subjected to sufficient thermal cycling for PCR in the PCR chamber 306, an initially blocked or closed PCR outlet channel 308 is opened as shown in FIG. 22 and centripetal force is used to force PCR product from PCR chamber 306 into PCR purification column 310, which occurs in region 522 shown in FIG. 22. As the PCR product passes through the PCR purification column 310, it is purified and reaches a PCR purification frit 312. The frit 312 can be used to further purify the PCR product as by size-exclusion or an affinity or binding reaction. Centripetal force can be used to force the purified PCR products through the frit 312, which occurs at region 523 shown in FIG. 23.

As shown in FIG. 23, two sequencing reaction chamber inlet channels 332 and 334 are provided in an initially blocked or closed configuration. In the method step depicted in FIG. 24, the sequencing reaction chamber inlet channels 332 and 334 are opened according to a deforming action and centripetal force is used to manipulate purified PCR product into both the forward sequencing reaction chamber 316 and the reverse sequencing reaction chamber 330, which occurs in region 524 of the pathway as shown in FIG. 24. FIG. 24 depicts the sequencing reaction chamber inlet channel 334 in an open position after deformation.

After the assembly is subjected to conditions that cause the forward and reverse sequencing reactions, the sequencing reaction chamber outlet channels 318 and 319, which are initially blocked or closed, are opened, which occurs in region 525 shown in FIG. 25. Under centripetal force, the products of the sequencing reactions flow through sequencing reaction purification chambers 320 and 328 and are collected in forward sequencing reaction product chamber 324 and reverse sequencing reaction product chamber 326, as shown in region 526 in FIG. 26. Before entering collection wells 324 and 326, the purified sequencing reaction products can also be forced to pass through sequencing reaction purification frits 322 and 321, respectively, in region 526 as shown in FIG. 26.

FIG. 27 shows the assembly of FIG. 17 after a sample has been manipulated through the series of chambers of the pathway to produce two sequencing reaction products from the sample.

FIGS. 28 and 29 depict the cross-section of the assembly shown in FIGS. 17–27. The assembly includes a substrate 368, a top cover film 360, a bottom cover film 361, PCR chamber 362, an underlying channel 366, a connecting duct or channel 364, and exemplary dimensions for features of the assembly and pathway. The substrate 368 can include an injection-molded cyclic olefin copolymer or polycarbonate. The input and output chambers, the channels for connecting the various chambers, the reaction chambers, and the purification columns can be molded features formed on the top surface 367 of the substrate 368. The bottom surface 369 of the substrate 368 can be machined or treated to form channels or passageways that connect the features formed in or on the top of the substrate 368. The top cover film 360 and bottom cover film 361 can fluid-tightly seal the series of chambers from one another and the environment. Under centripetal force, fluid in the assembly can flow, for example, through the lower channel 366 of the assembly, pass through the duct 364 of the assembly, and be forced into the adjacent chamber 362 formed in or on the top surface 367 of the substrate 368.

FIG. 30 is a top plan view of an assembly having a pathway that includes film covers over various channels and chambers of the pathway. Films and foils can form the top surface of the assembly in some areas, and can be used to seal chambers or channels and/or to conduct heat in areas of the assembly whether or not the film or foil also seals the covered chambers or channels. Although not shown, a cyclic olefin copolymer or other appropriate film cover can be secured to the bottom surface of the assembly. The cover 350 can include a silicone pressure sensitive adhesive layer on the surface thereof that contacts the top side of the assembly 347. The cover films 352 and 353 shown in FIG. 30 can be made of a cyclic olefin copolymer film for covering the channels and purification columns, for example, a copolymer film having a thickness of about 0.05 mm. Cover film 354 can be made of an aluminum foil or aluminum-containing PCR tape, as can cover film 350, to protect the polymerase chain reaction and sequencing reaction chambers and conduct heat efficiently and uniformly across an area. Aluminum foil film covers provided with silicone adhesive layers can be of any suitable thickness, for example, about 0.05 mm thick. The collection chambers or output wells 356 can be provided with a thinner cyclic olefin copolymer film, for example, having a thickness of about 0.025 mm.

FIG. 32 is a side view of an assembly according to an embodiment and resting on a support in a system that provides centripetal force, heating, and valving. FIG. 32 illustrates a system that can be useful in processing an assembly according to various embodiments. The system shown in FIG. 32 can be used to process a tiered multichannel assembly such as is schematically illustrated in FIG. 31.

FIG. 32 shows an assembly 400 in an elevated position and a position support on a platform 402. The direction of centripetal force is also indicated in the drawing figure as well as the region where heat is applied to perform thermal cycling. An exemplary position of a deformer 404 and a direction for actuation using the deformer is also depicted at FIG. 32.

FIGS. 33 through 40*b* depict a system according to various embodiments. The system 410 includes an electronics unit 412, a rotating platen 414, a heating assembly 416, a cover 418, and an enclosure basin 420. The device 410 also includes an assembly processing unit 370 shown in FIGS. 37–40*a*.

Figure 40B:
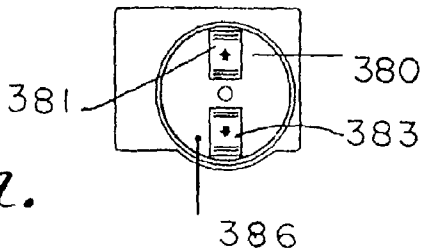
FIG. 40*b* is an enlarged view of a section of the system shown in FIG. 33, in partial cutaway to show two assemblies loaded for centripetal force spinning on the rotating platen.
Figure 40A:
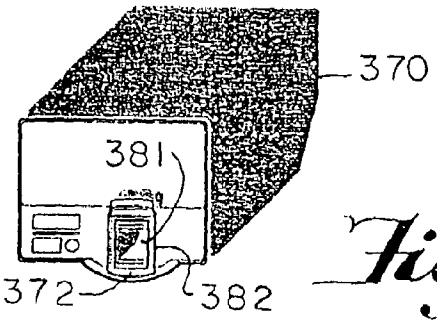
FIG. 40*a* is an enlarged view of a section of the system shown in FIG. 33 having an assembly loaded in the assembly-loading door.

The assembly processing component 370 includes a tray loading door 372, the electronics 412, a valve actuator 376, and two heaters 377 and 378. The component 370 shown particularly in FIG. 39 includes a two-assembly platen 380 for processing two assemblies simultaneously. The non-labelled arrows shown in FIG. 40*b* depict the direction of centripetal force applied to the assembly resulting from rotation of the platen 380 about a central axis 386 thereof. FIG. 40*a* shows tray loading door 372 in an open position and an assembly 381 loaded in the door and ready to be supported by the two-assembly platen 380 upon closure of the loading door 372.

Figure 41:
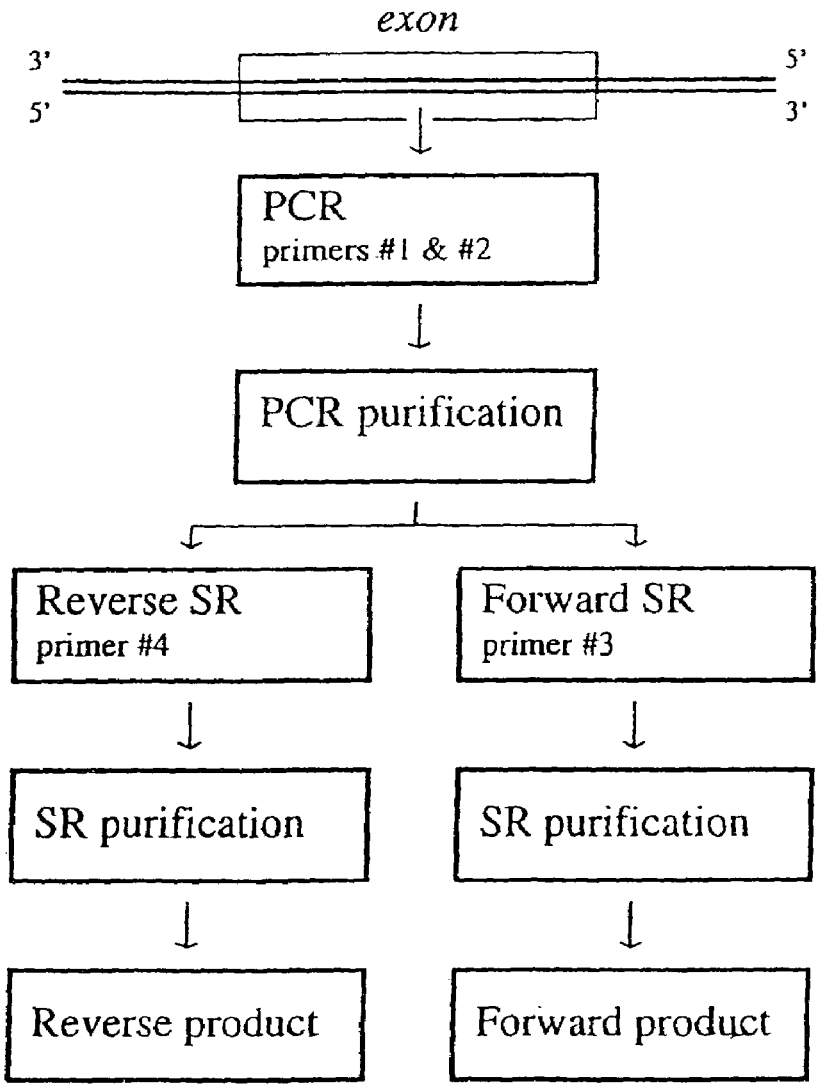
FIG. 41 is a flow chart showing the steps of an exemplary method according to various embodiments, that can be carried out in an assembly such as the assembly shown in FIG. 17.

FIG. 41 is a flow chart showing the steps of an exemplary method according to various embodiments, that can be carried out in an assembly such as shown in FIG. 17. FIG. 41 is a schematic flow chart of a polymerase chain reaction (PCR) and sequencing reaction method according to various embodiments. According to the method depicted in FIG. 41, a DNA template is subjected to a polymerase chain reaction. The purified PCR product is then divided into two portions which are respectively subjected to a reverse sequencing reaction and a forward sequencing reaction. After purification of the two sequencing reaction products, the reverse product and the forward product can be analyzed, further purified, further collected, or otherwise further processed.

FIGS. 42–47 depict the flow of reactants and reaction products from a method according to various embodiments wherein a template is processed through PCR and sequencing to produce a reverse sequencing reaction product and a forward sequencing reaction product.

Figure 46:
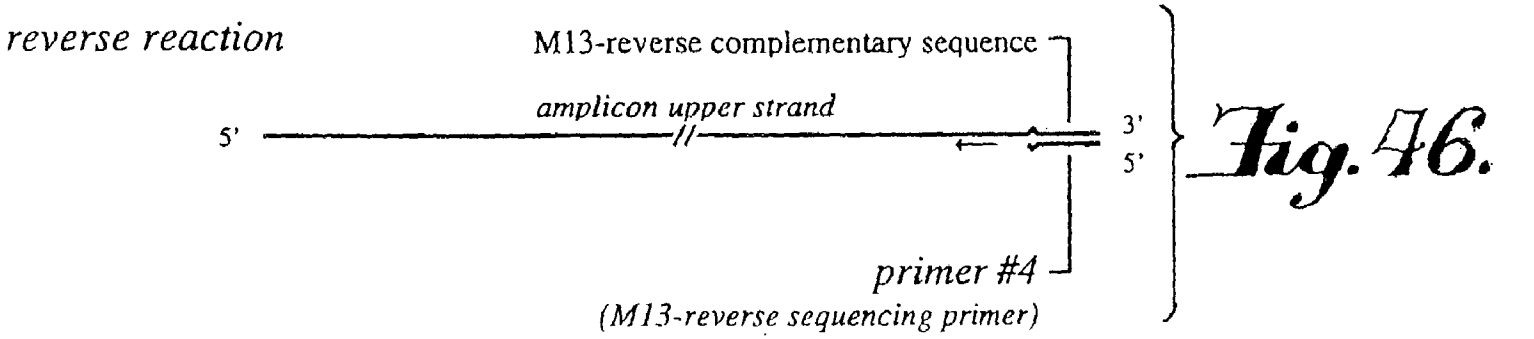
FIGS. 46 and 47 depict the reverse sequence reaction and the forward sequence reaction, respectively, that are useful in various embodiments of methods.
Figure 47:
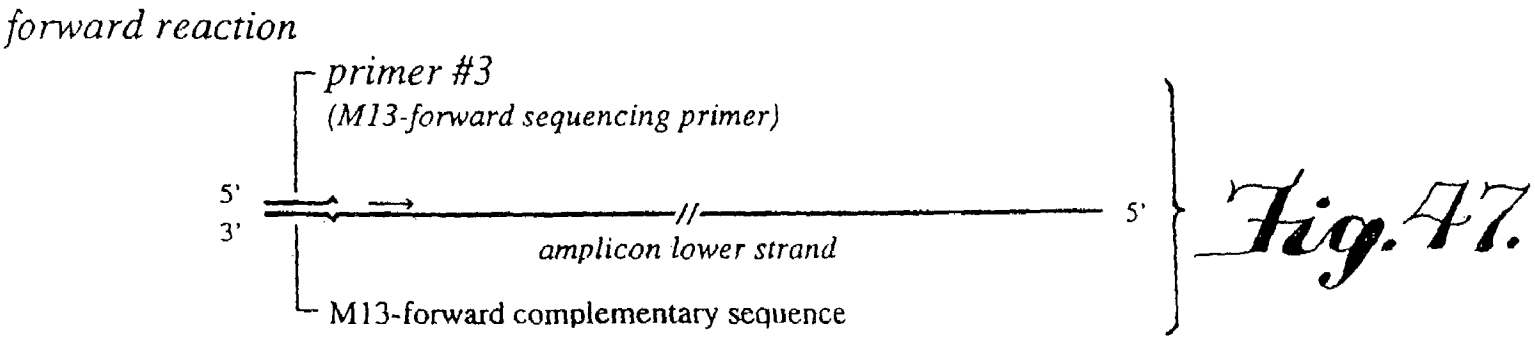

FIGS. 42 and 43 show exemplary PCR primers useful in methods according to various embodiments. FIGS. 44 and 45 show the template and amplicon, respectively, that are used and result from a PCR step according to various method embodiments. FIGS. 46 and 47 depict the reverse sequence reaction and the forward sequence reaction, respectively, that are useful in various embodiments of the methods.

In the methods depicted in FIGS. 42–47, the primers can anneal to the template in the early amplification cycles. The two amplicon strands can be sequenced using an M13 universal primer in either the forward sequencing reaction or in the reverse sequencing reaction. The 3' end of every amplicon produced in subsequent cycles contains the compliment to the M13 primer sequence in either the forward sequencing reaction or in the reverse sequencing reaction.

Further details regarding microfluidic devices, for example, devices having geometrically parallel processing pathways, and systems and apparatus including such devices or for processing such devices, are described in U.S. patent application Ser. No. 10/336,706 to Desmond et al., filed Jan. 3, 2003, entitled "Microfluidic Size-Exclusion Devices, Systems, and Methods", and in U.S. patent application Ser. No. 10/336,330 to Desmond et al., filed Jan. 3, 2003, entitled "Micro-Channel Design Features That Facilitate Centripetal Fluid Transfer", both of which are herein incorporated in their entireties by reference.

Those skilled in the art can appreciate from the foregoing description that the broad teachings of the present invention can be implemented in a variety of forms. Therefore, while this invention has been described in connection with particular embodiments and examples thereof, the true scope of the invention should not be so limited. Various changes and modification may be made without departing from the scope of the invention, as defined by the appended claims.

What is claimed is:

1. A fluid manipulation assembly comprising:

a substrate layer;

a first recess formed in the substrate layer;

a second recess formed in the substrate layer;

an intermediate wall, having a non-deformed state and a deformed state, interposed between the first recess and the second recess, wherein the intermediate wall comprises a deformable material having a first elasticity; and an elastically deformable cover layer covering the first recess and having a second elasticity that is greater than the first of elasticity, wherein the elastically deformable cover layer contacts the intermediate wall when the intermediate wall is in the non-deformed state, and wherein the elastically deformable cover layer does not contact the intermediate wall when the intermediate wall is in the deformed state, thereby forming a fluid communication between the first and second recesses.

2. The assembly of claim 1, wherein the substrate layer includes opposing first and second surfaces, the first surface faces the elastically deformable cover layer, and the assembly further comprises a base layer that contacts the second surface.

3. The assembly of claim 2, wherein the first recess is a hole through the substrate layer, and the first recess is at least partially defined by the base layer.

4. A fluid manipulation assembly comprising:

a substrate layer;

a first recess formed in the substrate layer, the first recess including a first recess portion and a second recess portion, the first recess being at least partially defined by opposing wall surface portions, at least one of the opposing wall surface portions comprising a first deformable material having a first elasticity, a non-deformed state, and a deformed state wherein the first recess portion and the second recess portion are in fluid communication With each other when the first deformable material is in the non-deformed state; and an elastically deformable cover layer having a second elasticity, that is greater than the first elasticity, covering at least the first recess portion, wherein the first deformable material is deformable to form a barrier wall interposed between the first recess portion and the second recess portion to prevent fluid communication between the first recess portion and the second recess portion when the first deformable material is in the deformed state.

5. The assembly of claim 4, wherein the substrate layer includes opposing first and second surfaces, the first surface faces the elastically deformable cover layer, and the assembly further comprises a base layer that contacts the second surface.

6. The assembly of claim 5, wherein the first recess is a hole through the substrate layer, and the first recess is at least partially defined by the base layer.

7. A method of forming a fluid communication between two recesses of an assembly, the assembly comprising:

a substrate layer, a first recess formed in the substrate layer, a second recess formed in the substrate layer;

an intermediate wall separating the first recess from the second recess, wherein the intermediate wall is formed from a deformable material having a first elasticity; and an elastically deformable cover layer, having a second elasticity that is greater than the first elasticity, covering the first recess, wherein the elastically deformable cover layer contacts the intermediate wall when the intermediate wall is in a non-deformed state, and wherein the elastically deformable cover layer does not contact the intermediate wall when the intermediate wall is in a deformed state thereby forming a fluid communication between the first and second recesses, the method comprising:

contacting the elastically deformable cover layer of the assembly with a deformer, wherein the contacting elastically deforms the elastically deformable cover layer adjacent the intermediate wall and deforms the intermediate wall; and bringing the deformer out of contact with the elastically deformable material layer such that a fluid communication results between the first and second recesses.

8. A method of forming a barrier to interrupt fluid communication between two recess portions of an assembly, the assembly comprising:

a substrate layer;

a first recess formed in the substrate layer, the first recess including a first recess portion and a second recess portion, the first recess being at least partially defined by opposing wall surface portions, at least one of the opposing wall surface portions comprising a first deformable material having a first elasticity, a non-deformed state, and a deformed state, wherein the first recess portion and the second recess portion are in fluid communication with each other when the first deformable material is in the non-deformed state; and an elastically deformable cover layer, having a second elasticity that is greater than the first elasticity, covering at least the first recess portion, wherein the first deformable material is deformable to form a barrier wall between the first recess portion and the second recess portion to interrupt fluid communication between the first recess portion and the second recess portion when the first deformable material is in the deformed state;

the method comprising:

contacting the elastically deformable cover layer with a deformer, wherein the contacting elastically deforms the elastically deformable cover layer adjacent the first deformable material and deforms the first deformable material to form the barrier wall.

9. A microfluidic manipulation system, comprising a fluid manipulating assembly, an assembly support platform, an assembly deformer, and a positioning unit, wherein:

the fluid manipulating assembly comprises a substrate layer, a first recess formed in the substrate layer, a second recess formed in the substrate layer, an intermediate wall separating the first recess from the second recess, wherein the intermediate wall is formed from a first deformable material having a first elasticity, and an elastically deformable cover layer, having a second elasticity that is greater than the first elasticity, covering the first recess, wherein the elastically deformable cover layer contacts the intermediate wall when the intermediate wall is in a non-deformed state, and wherein the elastically deformable cover layer does not contact the intermediate wall when the intermediate wall is in a deformed state, thereby forming a fluid communication between the first and second recesses;

the deformer comprises at least one contact surface that is more resistant to deformation than the first deformable material;

the fluid manipulating assembly is on the assembly support platform; and the positioning unit is adapted to position the deformer relative to the fluid manipulating assembly on the assembly support platform, such that the deformer can be forced to deform the first deformable material of the intermediate wall, through the elastically deformable material layer, to form a fluid communication between the first and second recesses.

10. The microfluidic manipulation system of claim 9, wherein said assembly further comprises one or more additional recesses separated from at least one of the first and second recesses, by one or more additional intermediate walls.

11. The microfluidic manipulation system of claim 9, wherein said assembly further comprises one or more additional recesses formed in the substrate layer, each of the one or more additional recesses being at least partially defined by a respective opposing wall surface portion that includes the first deformable material.

12. The microfluidic manipulation system of claim 9, further comprising an analyzer for analyzing the product of a sample processed with the system.

13. The microfluidic manipulation system of claim 9, wherein said elastically deformable cover layer includes an adhesive layer that contacts the substrate layer.

14. A microfluidic manipulation system, comprising a fluid manipulating assembly, an assembly support platform an assembly deformer, and a positioning unit, wherein:

the fluid manipulating assembly comprises a substrate layer, a first recess formed in the substrate layer, the first recess including a first recess portion and a second recess portion, the first recess being at least partially defined by opposing wall surface portions, at least one of the opposing wall surface portions comprising a first deformable material having a first elasticity, a deformed state, and a non-deformed state, wherein the first recess portion and the second recess portion are in fluid communication with each other when the first deformable material is in the non-deformed state, and an elastically deformable cover layer having a second elasticity that is greater than the first elasticity, covering at least the first recess portion, wherein the first deformable material is deformable to form a barrier wall between the first recess portion and the second recess portion to prevent fluid communication between the first recess portion and the second recess portion when the first deformable material is in the deformed state;

the deformer comprises at least one contact surface that is more resistant to deformation than the first deformable material;

the fluid manipulating assembly is on the assembly support platform; and the positioning unit is adapted to position the deformer relative to the fluid manipulating assembly on the assembly support platform such that the deformer can be forced to deform the first deformable material into a barrier wall that interrupts fluid communication between the first recess portion and the second recess portion.

15. The microfluidic manipulation system of claim 14, wherein said assembly further comprises one or more additional recesses formed in the substrate layer and separated from said first recess by an intermediate wall that includes the first deformable material.

16. The microfluidic manipulation system of claim 14, further including an analyzer for analyzing the product of a sample processed with the system.

17. A microfluidic manipulation system of claim 14, wherein said elastically deformable cover layer includes an adhesive layer that contacts the substrate layer.

18. The microfluidic manipulation system of claim 14, wherein said deformer includes two or more contact surfaces that separately contact the assembly.

19. A microfluidic manipulation system, comprising a fluid manipulating assembly, an assembly support means, a means for deforming, and a means for positioning, wherein:

The fluid manipulating assembly comprises a substrate layer, a first recess formed in the substrate layer, a second recess formed in the substrate layer, an intermediate wall separating the fist recess from the second recess, wherein the intermediate wall is formed from a first deformable material having a first elasticity, and an elastically deformable cover layer having a second elasticity that is greater than the fist elasticity, covering the first recess, wherein the elastically deformable cover layer contacts the intermediate wall when the intermediate wall is in a non-deformed state, and wherein the elastically deformable cover layer does not contact the intermediate wall when the intermediate wall is in a deformed state, thereby forming a fluid communication between the first and second recesses;

the means for deforming comprises at least one contact surface that is more resistant to deformation than the first deformable material; and the fluid manipulating assembly is on the assembly support platform; and the means for positioning is adapted to position the means for deforming relative to the fluid manipulating assembly supported by the assembly support means, such that the means for deforming can be forced to deform the first deformable material of the intermediate wall, through the elastically deformable material layer, to form a communication between the first recess portion and the second recess portion.

20. A microfluidic manipulation system, comprising a fluid manipulating assembly, an assembly support means, a means for deforming, and a means for positioning, wherein:

the fluid manipulating assembly comprises a substrate layer, a first recess formed in the substrate layer, the first recess including a first recess portion and a second recess portion, the first recess being at least partially defined by opposing wall surface portions, at least one of the opposing wall surface portions comprising a first deformable material having a deformed state and a non-deformed state, wherein the first recess portion and the second recess portion are in fluid communication with each other when the first deformable material is in the non-deformed state, and an elastically deformable cover layer covering at least the first recess portion, wherein the opposing wall surface portion that comprises the first deformable material is deformable to form a barrier wall between the first recess portion and the second recess portion to prevent fluid communication between the first recess portion and the second recess portion when the first deformable material is in the deformed state;

the means for deforming comprises at least one contact surface that is more resistant to deformation than the first deformable material;

the fluid manipulating assembly is on the assembly support platform; and the means for positioning is adapted to position the means for deforming relative to the fluid manipulating assembly on the assembly support means, such that the means for deforming can be forced to deform the first deformable material into a barrier wall that interrupts fluid communication between the first recess portion and the second recess portion.

* * * * *